US010458213B1

(12) United States Patent
Eitschberger et al.

(10) Patent No.: US 10,458,213 B1
(45) Date of Patent: Oct. 29, 2019

(54) POSITIONING DEVICE FOR SHAPED CHARGES IN A PERFORATING GUN MODULE

(71) Applicant: DynaEnergetics GmbH & Co. KG, Troisdorf (DE)

(72) Inventors: Christian Eitschberger, München (DE); Arash Shahinpour, Troisdorf (DE); Gernot Uwe Burmeister, Austin, TX (US); Thilo Scharf, Donegal (IE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 16/272,326

(22) Filed: Feb. 11, 2019

Related U.S. Application Data

(60) Provisional application No. 62/780,427, filed on Dec. 17, 2018, provisional application No. 62/699,484, filed on Jul. 17, 2018.

(51) Int. Cl.
*E21B 43/1185* (2006.01)
*E21B 33/068* (2006.01)
*E21B 47/09* (2012.01)

(52) U.S. Cl.
CPC ..... *E21B 43/1185* (2013.01); *E21B 33/068* (2013.01); *E21B 47/09* (2013.01)

(58) Field of Classification Search
CPC ..... E21B 43/11; E21B 43/116; E21B 43/117
See application file for complete search history.

(56) References Cited

U.S. PATENT DOCUMENTS

| | | | | |
|---|---|---|---|---|
| 3,013,491 | A | 12/1961 | Poulter | |
| 3,565,188 | A | 2/1971 | Hakala | |
| 4,140,188 | A * | 2/1979 | Vann | E21B 43/117 166/63 |
| 4,312,273 | A | 1/1982 | Camp | |
| 4,496,008 | A | 1/1985 | Pottier et al. | |
| 4,534,423 | A | 8/1985 | Regalbuto | |
| 4,598,775 | A * | 7/1986 | Vann | E21B 43/117 102/310 |
| 4,609,057 | A | 9/1986 | Walker et al. | |

(Continued)

FOREIGN PATENT DOCUMENTS

| | | | |
|---|---|---|---|
| CA | 2941648 A1 * | 9/2015 | B01D 81/20 |
| CN | 201620848 U | 11/2010 | |

(Continued)

OTHER PUBLICATIONS

Wade et al., Field Tests Indicate New Perforating Devices Improve Efficiency in Casing Completion Operations, SPE 381, pp. 1069-1073, Oct. 1962, 5 pgs.

(Continued)

*Primary Examiner* — Jennifer H Gay
(74) *Attorney, Agent, or Firm* — Moyles IP, LLC

(57) ABSTRACT

A positioning device includes a shaped charge holder. A plurality of shaped charge receptacles formed in the shaped charge holder are configured to arrange a plurality of shaped charges in a desired orientation. The shaped charges are detonated by a detonator in response to an initiation signal. The positioning device may be secured in a perforating gun module, with vertical and horizontal movement of the positioning being inhibited in the perforating gun module.

25 Claims, 17 Drawing Sheets

(56) References Cited

U.S. PATENT DOCUMENTS

| | | | | |
|---|---|---|---|---|
| 4,621,396 | A * | 11/1986 | Walker | E21B 43/117 102/321.1 |
| 4,747,201 | A | 5/1988 | Donovan et al. | |
| 4,753,170 | A * | 6/1988 | Regalbuto | C06C 5/04 102/200 |
| 4,790,383 | A | 12/1988 | Savage et al. | |
| 4,800,815 | A * | 1/1989 | Appledorn | E21B 43/117 102/312 |
| 5,006,833 | A | 4/1991 | Marlowe et al. | |
| 5,648,635 | A | 7/1997 | Lussier et al. | |
| 5,775,426 | A | 7/1998 | Snider et al. | |
| 5,785,130 | A | 7/1998 | Wesson et al. | |
| 5,816,343 | A | 10/1998 | Markel et al. | |
| 5,837,925 | A | 11/1998 | Nice | |
| 6,412,415 | B1 | 7/2002 | Kothari et al. | |
| 6,439,121 | B1 | 8/2002 | Gillingham | |
| 6,487,973 | B1 | 12/2002 | Gilbert, Jr. et al. | |
| 6,497,285 | B2 | 12/2002 | Walker | |
| 7,107,908 | B2 | 9/2006 | Forman et al. | |
| 7,278,491 | B2 | 10/2007 | Scott | |
| 7,347,279 | B2 | 3/2008 | Li et al. | |
| 7,441,601 | B2 | 10/2008 | George et al. | |
| 7,735,578 | B2 | 6/2010 | Loehr et al. | |
| 7,752,971 | B2 | 7/2010 | Loehr | |
| 7,762,351 | B2 | 7/2010 | Vidal | |
| 8,066,083 | B2 | 11/2011 | Hales et al. | |
| 8,327,746 | B2 | 12/2012 | Behrmann et al. | |
| 8,904,935 | B1 | 12/2014 | Brown et al. | |
| 9,133,695 | B2 | 9/2015 | Xu | |
| 9,194,219 | B1 | 11/2015 | Hardesty et al. | |
| 9,382,783 | B2 | 7/2016 | Langford et al. | |
| 9,581,422 | B2 * | 2/2017 | Preiss | F42C 19/12 |
| 9,605,937 | B2 * | 3/2017 | Eitschberger | F42C 19/12 |
| 9,689,223 | B2 | 6/2017 | Schacherer et al. | |
| 9,702,680 | B2 * | 7/2017 | Parks | F42D 1/02 |
| 9,784,549 | B2 * | 10/2017 | Eitschberger | F42D 1/05 |
| 10,000,994 | B1 | 6/2018 | Sites | |
| 10,066,921 | B2 * | 9/2018 | Eitschberger | F42D 1/05 |
| 10,077,641 | B2 * | 9/2018 | Rogman | E21B 43/116 |
| 10,151,180 | B2 * | 12/2018 | Robey | E21B 43/117 |
| 10,188,990 | B2 * | 1/2019 | Burmeister | B01D 61/20 |
| 10,190,398 | B2 | 1/2019 | Goodman et al. | |
| 2005/0194146 | A1 | 9/2005 | Barker et al. | |
| 2008/0121095 | A1 | 5/2008 | Han et al. | |
| 2008/0149338 | A1 | 6/2008 | Goodman et al. | |
| 2008/0264639 | A1 | 10/2008 | Parrott et al. | |
| 2012/0247769 | A1 | 10/2012 | Schacherer et al. | |
| 2012/0298361 | A1 | 11/2012 | Sampson | |
| 2013/0008639 | A1 | 1/2013 | Tassaroli | |
| 2015/0226044 | A1 | 8/2015 | Ursi et al. | |
| 2015/0330192 | A1 * | 11/2015 | Rogman | E21B 43/116 166/297 |
| 2016/0061572 | A1 * | 3/2016 | Eitschberger | F42C 19/12 89/1.15 |
| 2016/0084048 | A1 | 3/2016 | Harrigan et al. | |
| 2016/0273902 | A1 * | 9/2016 | Eitschberger | F42D 1/05 |
| 2017/0030693 | A1 * | 2/2017 | Preiss | F42C 19/12 |
| 2017/0052011 | A1 * | 2/2017 | Parks | F42D 1/02 |
| 2017/0058649 | A1 | 3/2017 | Geerts et al. | |
| 2017/0145798 | A1 * | 5/2017 | Robey | E21B 43/117 |
| 2017/0167233 | A1 | 6/2017 | Sampson et al. | |
| 2017/0268860 | A1 * | 9/2017 | Eitschberger | F42D 1/05 |
| 2018/0030334 | A1 * | 2/2018 | Collier | E21B 43/117 |
| 2018/0209251 | A1 * | 7/2018 | Robey | E21B 43/117 |
| 2018/0274342 | A1 * | 9/2018 | Sites | E21B 43/117 |
| 2018/0306010 | A1 * | 10/2018 | Von Kaenel | E21B 43/117 |
| 2019/0040722 | A1 * | 2/2019 | Yang | E21B 43/117 |
| 2019/0049225 | A1 * | 2/2019 | Eitschberger | F42D 1/05 |

FOREIGN PATENT DOCUMENTS

| | | | |
|---|---|---|---|
| RU | 2633904 | C1 | 10/2017 |
| WO | 2019148009 | A2 | 8/2019 |

OTHER PUBLICATIONS

Hunting Titan, Inc., U.S. Appl. No. 62/621,999 titled Cluster Gun System and filed Jan. 25, 2018, which is a priority application of International App. No. PCT/US2019/015255 published as WO2019/148009, dated Aug. 1, 2019, 7 pages, WIPO.

Hunting Titan, Inc., U.S. Appl. No. 62/627,591 titled Cluster Gun System and filed Feb. 7, 2018, which is a priority application of International App. No. PCT/US2019/015255 published as WO2019/148009, dated Aug. 1, 2019, 7 pages, WIPO.

Hunting Titan, Inc., U.S. Appl. No. 62/736,298 titled Starburst Cluster Gun and filed Sep. 25, 2018, which is a priority application of International App. No. PCT/US2019/015255 published as International Publication No. WO2019/148009, dated Aug. 1, 2019, 34 pages, WIPO.

Intellectual Property India, Office Action of in Application No. 201647004496, which is in the same family as U.S. Pat. No. 9,702,680, dated Jun. 7, 2019, 6 pgs.

SIPO, Search Report dated Mar. 29, 2017, in Chinese: See Search Report for CN App No. 2014800404569, which is in the same family as U.S. Pat. No. 9,702,680 issued Jul. 11, 2017, 12 pgs.

World Intellectual Property Office, Search Report for GB Patent App. No. GB1700625.5, which is in the same family as U.S. Pat. No. 9,702,680 issued Jul. 11, 2017, dated Jul. 7, 2017, 5 pages.

GB Intellectual Property Office, Office Action dated Feb. 27, 2018, See Office Action for App. No. GB 1717516.7, which is in the same family as U.S. Pat. No. 9,702,680 issued Jul. 11, 2017, 6 pg.

Norwegan Industrial Property Office, Office Action for NO Patent App. No. 20160017, which is in the same family as U.S. Pat. No. 9,702,680 issued Jul. 11, 2017, dated Jun. 15, 2017, 3 pgs.

Norwegan Industrial Property Office, Search Report for NO Patent App. No. 20160017, which is in the same family as U.S. Pat. No. 9,702,680 issued Jul. 11, 2017, dated Jun. 15, 2017, 2 pgs.

FIIP, Search Report dated Feb. 1, 2018, in Russian: See Search Report for RU App. No. 2016104882/03, which is in the same family as U.S. Pat. No. 9,702,680 issued Jul. 11, 2017, 7 pgs.

International Search Report of International Application No. PCT/CA2014/050673, which is in the same family as U.S. Pat. No. 9,702,680 issued Jul. 11, 2017, dated Oct. 9, 2014, 3 pgs.

Amit Govil, Selective Perforation: A Game Changer in Perforating Technology—Case Study, presented at the 2012 European and West African Perforating Symposium, 14 pgs.

UK Examination Report of United Kingdom Patent Application No. GB1600085.3, which is in the same family as U.S. Pat. No. 9,702,680 issued Jul. 11, 2017, dated Mar. 9, 2016, 1 pg.

International Written Opinion of International Application No. PCT/CA2014/050673, which is in the same family as U.S. Pat. No. 9,702,680 issued Jul. 11, 2017, dated Sep. 24, 2014, 4 pgs.

* cited by examiner

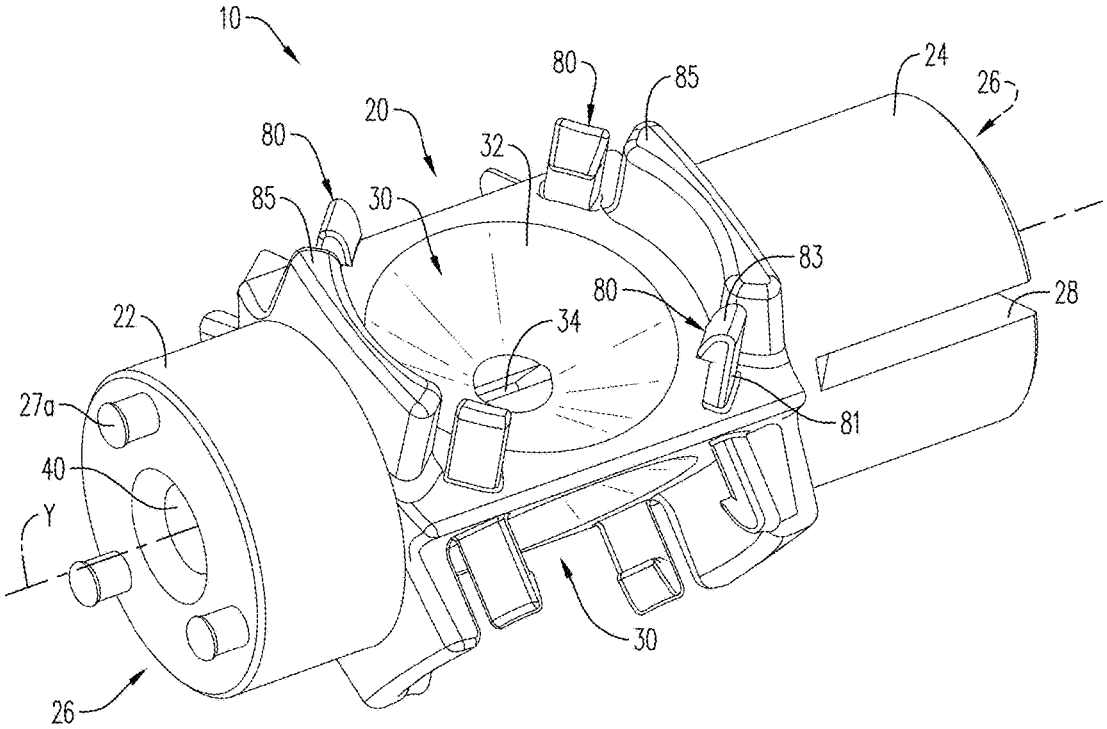
FIG. 2
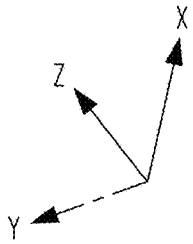

POSITIONING DEVICE FOR SHAPED CHARGES IN A PERFORATING GUN MODULE

CROSS-REFERENCE TO RELATED APPLICATIONS

The present application claims the benefit of U.S. Provisional Application No. 62/699,484 filed Jul. 17, 2018 and U.S. Provisional Application No. 62/780,427 filed Dec. 17, 2018, each of which is incorporated herein by reference in its entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling, a perforating gun assembly, or train or string of multiple perforating gun assemblies, are lowered into the wellbore, and positioned adjacent one or more hydrocarbon reservoirs in underground formations.

Assembly of a perforating gun requires assembly of multiple parts. Such parts typically include a housing or outer gun barrel. An electrical wire for communicating from the surface to initiate ignition, a percussion initiator and/or a detonator, a detonating cord, one or more charges which are held in an inner tube, strip or carrying device and, where necessary, one or more boosters are typically positioned in the housing. Assembly of the perforating gun typically includes threaded insertion of one component into another by screwing or twisting the components into place. Tandem seal adapters/subs are typically used in conjunction with perforating gun assemblies to connect multiple perforating guns together. The tandem seal adapters are typically configured to provide a seal between adjacent perforating guns. Some tandem seal adapters may be provided internally or externally between adjacent perforating guns, which, in addition to requiring the use of multiple parts or connections between the perforating guns, may increase the length of each perforating gun and may be more expensive to manufacture. One such system is described in PCT Publication No. WO 2015/179787A1 assigned to Hunting Titan Inc.

The perforating gun includes explosive charges, typically shaped, hollow or projectile charges, which are initiated to perforate holes in the casing and to blast through the formation so that the hydrocarbons can flow through the casing. The explosive charges may be arranged in a hollow charge carrier or other holding devices. Once the perforating gun(s) is properly positioned, a surface signal actuates an ignition of a fuse or detonator, which in turn initiates a detonating cord, which detonates the explosive charges to penetrate/perforate the casing and thereby allow formation fluids to flow through the perforations thus formed and into a production string. Upon detonation of the explosive charges, debris typically remains inside the casing/wellbore. Such debris may include shrapnel resulting from the detonation of the explosive charges, which may result in obstructions in the wellbore. Perforating gun assemblies may be modified with additional components, end plates, internal sleeves, and the like in an attempt to capture such debris. U.S. Pat. No. 7,441,601 to GeoDynamics Inc., for example, describes a perforating gun assembly having an inner sleeve configured with pre-drilled holes that shifts in relation to an outer gun barrel upon detonation of the explosive charges in the perforating gun, to close the holes formed by the explosive charges. Such perforating gun assemblies require numerous components, may be costly to manufacture and assemble, and may reduce/limit the size of the explosive charges, in relation to the gun diameter, which may be compatible with the gun assembly.

There is a need for an improved perforating gun assembly that does not require the use of tandem seal adapters or tandem subs to facilitate a sealed connection between perforating gun assemblies. There is a further need for a perforating gun assembly that includes an efficient design for capturing debris resulting from detonation of a plurality of shaped charges.

BRIEF DESCRIPTION OF THE EXEMPLARY EMBODIMENTS

Embodiments of the disclosure are associated with a positioning device. The positioning device includes a shaped charge holder configured for arranging/positioning a plurality of shaped charges therein. According to an aspect, the shaped charges are positioned in an XZ-plane, in an outward, radial arrangement about a central-axis/Y-axis/central Y-axis of the shaped charge holder. The shaped charges may be designed so that, regardless of their sizes, they create perforating tunnels having a geometry (such as a length and width) that cumulatively facilitates a flow rate that is equivalent to the flow rate facilitated by other shaped charges of different sizes. Each shaped charge includes an open front end, and a back wall including an initiation point. A detonator may be positioned centrally within the shaped charge holder, adjacent the initiation point. According to an aspect, the detonator is a wireless detonator and the shaped charges are directly initiated by the detonator in response to an initiation signal.

The present embodiments may further be associated with a positioning device for a plurality of shaped charges. The positioning device includes a first end and a second end, and a shaped charge holder extending between the first and second ends. The shaped charge holder includes a plurality of shaped charge receptacles radially arranged in an XZ-plane about a Y-axis of the shaped charge holder. Each of the receptacles is configured for receiving one of the shaped charges, so that the received shaped charges are similarly radially arranged in the XZ-plane about the central Y-axis of the shaped charge holder. According to an aspect, the shaped charge receptacles include a depression and an opening formed in the depression. An elongated cavity may extend through the positioning device from the first end to the second end. The elongated cavity is adjacent each of the shaped charge receptacles and is in communication with the elongated opening. According to an aspect, a detonator is positioned in the elongated opening and configured to initiate the shaped charges simultaneously, in response to an initiation signal.

Further embodiments of the disclosure may be associated with a positioning device including a first end, a second end, and an elongated cavity/lumen extending through the positioning device from the first end to the second end. A shaped charge holder is included in the positioning device and extends between the first and second ends. The shaped charge holder is configured substantially as described hereinabove, and each of its shaped charge receptacles is configured for receiving one of the shaped charges. According to an aspect, the elongated opening of the positioning device is configured for retaining a detonator therein and is adjacent the shaped charge receptacles. The arrangement of the detonator in the elongated opening facilitates direct and simultaneous initiation of the shaped charges via the detonator, which may occur in response to an initiation signal. According to an aspect, the positioning device may further include at least one rib. The rib outwardly extends from the positioning device. When the holder is positioned in a perforating gun module/carrier, the fin may engage with an inner surface of the perforating gun module to prevent movement of the positioning device, and thus the shaped charges, vertically in the perforating gun module.

Embodiments of the disclosure may further be associated with a shaped charge for use with a shaped charge holder, or a positioning device including a shaped charge holder, configured substantially as described hereinabove. The shaped charge includes a substantially cylindrical/conical case having an open front end, and a back wall having an initiation point extending there through, and at least one cylindrical side wall extending between the open front end and the back wall. An explosive load is disposed within the hollow interior of the case, and is positioned so that it is adjacent at least a portion of an internal surface of the case. According to an aspect, a liner is pressed into or positioned over the explosive load. The liner may be seated within the case adjacent the internal surface to enclose the explosive load therein. According to an aspect, at least one of the internal surface, the liner geometry and/or liner constituents, and the explosive load is modified to change the shape of a perforating jet formed upon detonation of the shaped charge. The resulting perforation jet creates a perforating tunnel that has a geometry that facilitates a flow rate or hydraulic fracturing that is equivalent to the flow rate or the hydraulic fracturing typically facilitated by another shaped charge of a different size or composition. According to an aspect, the side wall includes an engagement member outwardly extending from an external surface of the side wall. The engagement member is configured for coupling the shaped charge within a shaped charge receptacle of a shaped charge holder configured substantially as described herein. The shaped charge does not require the use of detonating cord guides at the back of the shaped charge and eliminates the need for a turning process during manufacture of the shaped charge. This may result in reduced manufacturing costs as the shaped charge has less contoured surfaces as standard shaped charges.

Further embodiments of the disclosure may be associated with a perforating gun module. The perforating gun module includes a housing having a first housing end and a second housing end. A chamber extends from the first housing end towards the second housing end, and a positioning device is secured in the chamber. The positioning device may be configured substantially as defined hereinabove. According to an aspect, the positioning devices includes the shaped charge holder including shaped charge receptacles that are radially arranged in an XZ-plane about a Y-axis of the shaped charge holder. The positioning device includes at least one rib extending therefrom and engaging with an inner surface of the housing of the perforating gun module, thereby reducing movement of the positioning device, and thus the orientation of the shaped charges, within the perforating gun module. The shaped charge holder may be configured to house and retain a detonator in an elongated cavity, and a plurality of shaped charges may be arranged in the shaped charge receptacles. The detonator is arranged so that it is directly energetically coupled to the shaped charges, which may eliminate the requirement for use of a detonating cord to activate the shaped charges. According to an aspect, the housing of the housing of the perforating gun module is specially designed to capture a resulting mass created by the activation of the shaped charges. This helps to minimize debris that may remain in the wellbore after detonation of the shaped charges.

Embodiments of the disclosure may further be associated with a method of making the perforating gun module described herein. The method includes forging a housing from a solid metal material and providing a positioning device for being received in a chamber of the housing. According to an aspect, the positioning device is formed from an injection molded, casted, or 3D printed plastic material or 3-D milled and cut from solid plastic bar stock. The positioning device may be configured substantially as described hereinabove. The positioning device is arranged within a chamber of the housing so that the shaped charges are positioned in an XZ-plane, in an outward, radial arrangement, about a Y-axis of the shaped charge holder.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which:

FIG. 2 is a side, perspective view of the positioning device of FIG. 1;

Figure 1:
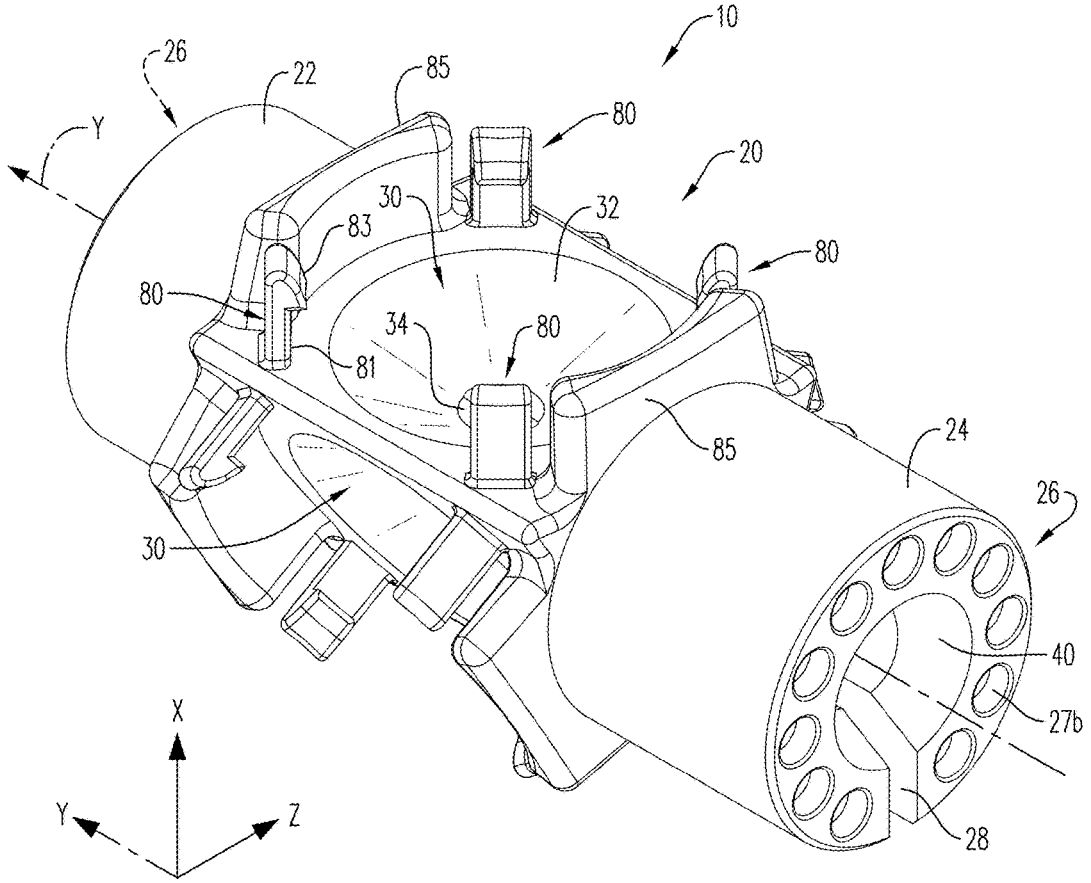
FIG. 1 is a perspective view of a positioning device, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

As used herein, the term "energetically" may refer to a detonating/detonative device that, when detonated/or activated, generates a shock wave impulse that is capable of reliably initiating an oilfield shaped charge, booster or section of detonating cord to a high order detonation.

The terms "pressure bulkhead" and "pressure bulkhead structure" shall be used interchangeably, and shall refer to an internal, perforating gun housing compartment of a select fire sub assembly. In an embodiment, it also contains a pin assembly and allows the electrical passage of a wiring arrangement. The bulkhead structures may include at least one electrically conductive material within its overall structure.

For purposes of illustrating features of the embodiments, simple examples will now be introduced and referenced throughout the disclosure. Those skilled in the art will recognize that these examples are illustrative and not limiting and are provided purely for explanatory purposes. As other features of a perforating gun assembly are generally known (such as detonator and shaped charge design structures), for ease of understanding of the current disclosure those other features will not be otherwise described herein except by reference to other publications as may be of assistance.

FIGS. 1-2 illustrate a positioning device 10 configured for arranging a plurality of shaped charges 120 (FIG. 6) in a selected configuration. The shaped charges 120 may be positioned in an XZ-plane, in an outward, radial arrangement, about a Y-axis of the shaped charge holder 20; the Y-axis in the figures is the central axis of the shaped charge holder 20. The positioning device 10 may be configured as a unitary structure formed from a plastic material. According to an aspect, the positioning device 10 is formed from an injection molded material, a casted material, a 3D printed or 3-D milled material, or a machine cut solid material. Upon detonation of the shaped charges 120 positioned in the shaped charge holder 20, the positioning device may partially melt/soften to capture any shrapnel and dust generated by the detonation.

The positioning device 10 includes a first end 22 and a second end 24, and a shaped charge holder 20 extending between the first and second ends 22, 24. According to an aspect, the shaped charge holder 20 includes a plurality of shaped charge receptacles 30. The receptacles 30 are arranged between the first and second ends 22, 24 of the positioning device 10. The shaped charge receptacles 30 may be radially arranged in the XZ-plane about the Y-axis, i.e., central axis, of the shaped charge holder 20, each being configured to receive one of the shaped charges 120.

Figure 5:
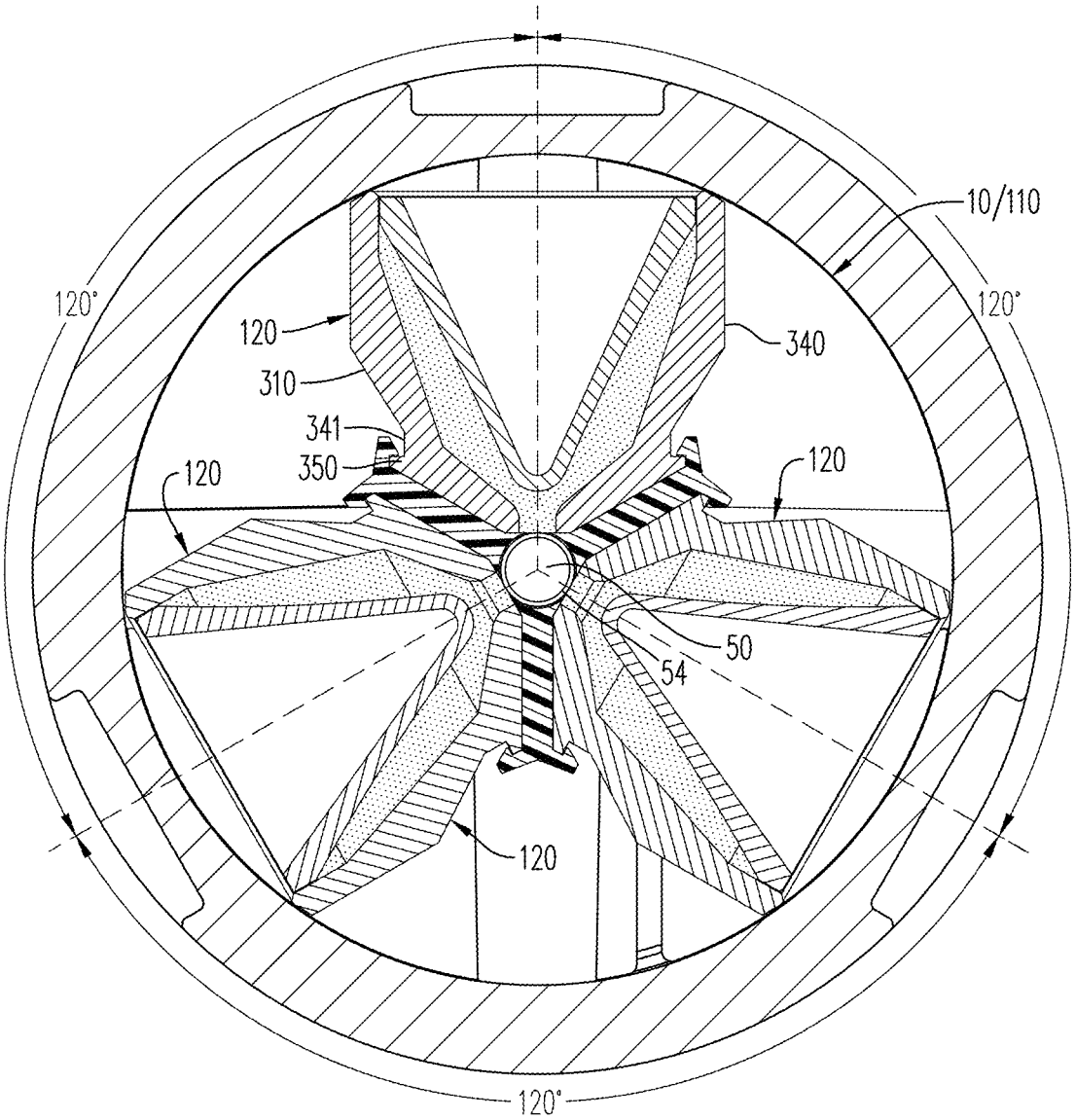
FIG. 5 is a cross-sectional view of a positioning device, illustrating a plurality of shaped charges positioned in shaped charge receptacles, according to an aspect.

According to an aspect, the shaped charge receptacles 30 may include a depression/recess 32 that extends inwardly into the positioning device 10. An opening/slot 34 is formed in the depression 30. The opening 34 is configured to facilitate communication between contents of the depression 32 (i.e., the shaped charges 120) and a detonative device that extends through the positioning device 10. In an embodiment and as illustrated in FIG. 5, the opening 34 of each of the shaped charge receptacles 30, and the shaped charges 120, is spaced from about 60° to about 120° from each other. According to an aspect, the shaped charge receptacles 30 may be spaced apart from each other equidistantly, which may aid in reducing the formation breakdown pressure during hydraulic fracturing. The positioning device 10 may include 2, 3, 4, 5, 6 or more receptacles 30, depending on the needs of the application.

The shaped charge receptacles 30 may be configured to receive shaped charges 120 of different configurations and/or sizes. As would be understood by one of ordinary skill in the art, the geometries of the perforating jets and/or perforations (holes or perforating holes) that are produced by the shaped charges 120 upon detonation depends, at least in part, on the shape of the shaped charge case, the shape of the liner and/or the blend of powders included in the liner. The geometries of the perforating jets and holes may also depend on the quantity and type of explosive load included in the shaped charge. The shaped charges 120 may include, for example, substantially the same explosive gram weight, the interior surface of the shaped charge case and/or the design of the liner may differ for each shaped charge 120 in order to produce differently sized or shaped perforations.

According to an aspect, the receptacles 30 are configured to receive at least one of 3 g to 61 g shaped charges. It is contemplated, for example, that the receptacles may be sized to receive 5 g, 10 g, 26 g, 39 g and 50 g shaped charges 120. Adjusting the size of the shaped charges 120 (and thereby the quantity of the explosive load in the shaped charges 120) positioned in the shaped charge receptacles 30 may impact the size of the entrance holes/perforations created in a target formation upon detonation of the shaped charges 120.

The positioning device 10 may include three (3) shaped charges receptacles 30, with a shaped charge 120 being positioned in each receptacle 30. Upon detonation of the shaped charges 120, three (3) perforating holes having an equal entrance hole diameter of an amount ranging from about 0.20 inches to about 0.55 inches are formed. To be sure, the equal entrance hole diameter of the perforations will include a deviation of less than 10%. For example, three specially designed shaped charges 120, each including 10 g of explosive load, may be installed in a positioning device 10. Upon detonation of these shaped charges 120, they may perform equivalent to a standard shaped charge carrier that has three standard shaped charges that each include 22.7 g explosive load. The enhanced performance of the specially designed shaped charges 120 may be facilitated, at least in part, may the type of explosive powder selected for the explosive load, the shape and constituents of the liner and the contours/shape of the internal surface of the shaped charge case.

The combined surface area of the hole diameters may be equivalent to the total surface area that would be formed by an arrangement of 2, 4, 5, 6 or more standard shaped charges of a standard perforating gun. The ability of the shaped charge receptacles 30 to receive shaped charges 120 of different sizes or components helps to facilitate a shot performance that is equivalent to that of a traditional shaped charge carrier including 2, 4, 5, 6 or more shaped charges. Thus, without adjusting the quantity/number of the shaped charges 120 and/or the receptacles 30 of the positioning device 10, the total surface area of the perforations (i.e., the area open to fluid flow) created by detonating the shaped charges 120 is effectively adjusted based on the size and type of the shaped charges 120 utilized in the positioning device 10. This may facilitate a cost-effective and efficient way of adjusting the optimal flow path for fluid in the target formation, without modifying the arrangement or quantity of the receptacles 30.

According to an aspect, the positioning device 10 includes one or more mechanisms that help to guide and/or secure the shaped charges within the shaped charge receptacles 30. The positioning device may include a plurality of shaped charge positioning blocks/bars 85 outwardly extending from the shaped charge holder 20. The positioning blocks 85 may help to guide the arrangement, mounting or placement of the shaped charges 120 within the shaped charge receptacles 30. The positioning blocks 85 may be contoured to correspond to a general shape of the shaped charges 120, such as conical or rectangular shaped charges. According to an aspect, the positioning blocks 85 provides added strength and stability to the shaped charge holder 20 and helps to support the shaped charges 120 in the shaped charge holder 20.

According to an aspect, the positioning device 10 further includes a plurality of retention mechanisms 80 outwardly extending from the holder 20. The retention mechanisms 80 may be adjacent each of the shaped charge receptacles 30. As illustrated in FIG. 1 and FIG. 2, the retention mechanisms 80 may be arranged in a spaced apart configuration from each other. Each retention mechanism 80 may be adjacent one shaped charge positioning block 85. For instance, each member of a pair of the retention mechanisms 80 may be spaced at about a 90° degree angle from an adjacent retention mechanism 80. The pair of retention mechanisms 80 may be configured to retain one of the shaped charges 120 within one shaped charge receptacle 30. The retention mechanisms 80 may each include an elongated shaft 81, and a hook 83 that extends outwardly from the elongated shaft. The hook 83 is at least partially curved to engage with a cylindrical wall of the shaped charges 120, thereby helping to secure the shaped charge 120 within its corresponding shaped charge receptacle 30, and thus the shaped charge holder 20.

According to an aspect, the depression 32 of the shaped charge receptacles 30, in combination with at least one of the retention mechanisms 80 and the shaped charge positioning blocks 85, aid in mechanically securing at least one of the shaped charges 120 within the positioning device 10.

An elongated cavity/lumen 40 extends through the positioning device 10, from the first end 22 to the second end 24. The elongated cavity 40 may be centrally located within the positioning device 10 and is adjacent each of the shaped charge receptacles 30, and thereby the shaped charge 120 housed in the receptacles 30.

Figure 6:
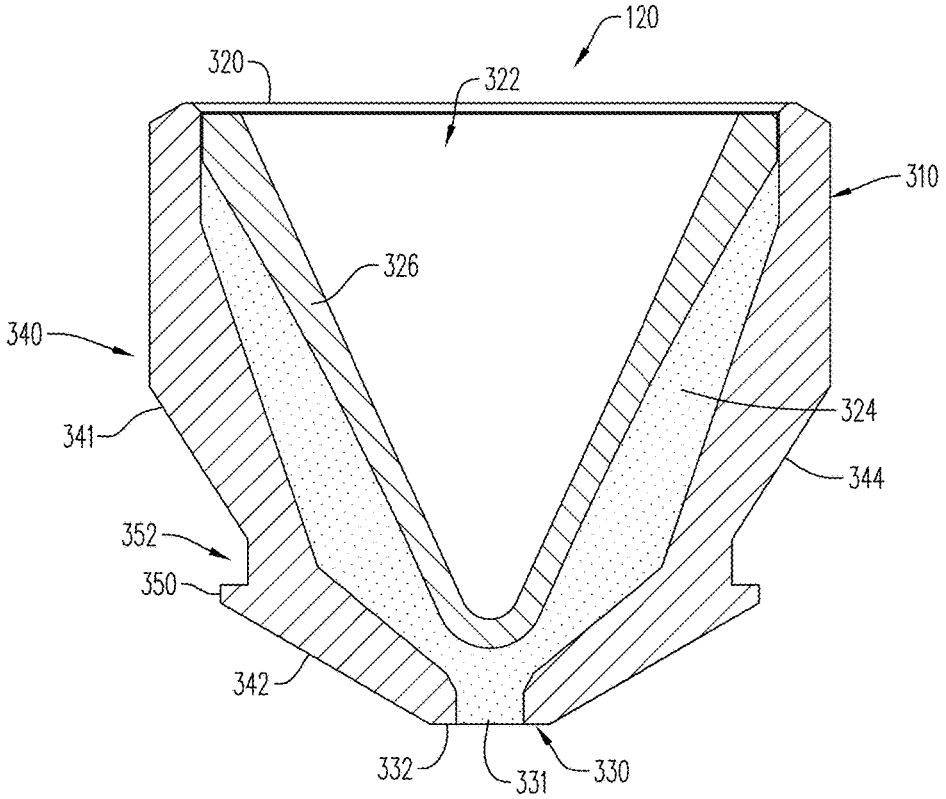
FIG. 6 is a partial, cross-sectional view of a shaped charge for use with a positioning device, according to an aspect.
Figure 11:
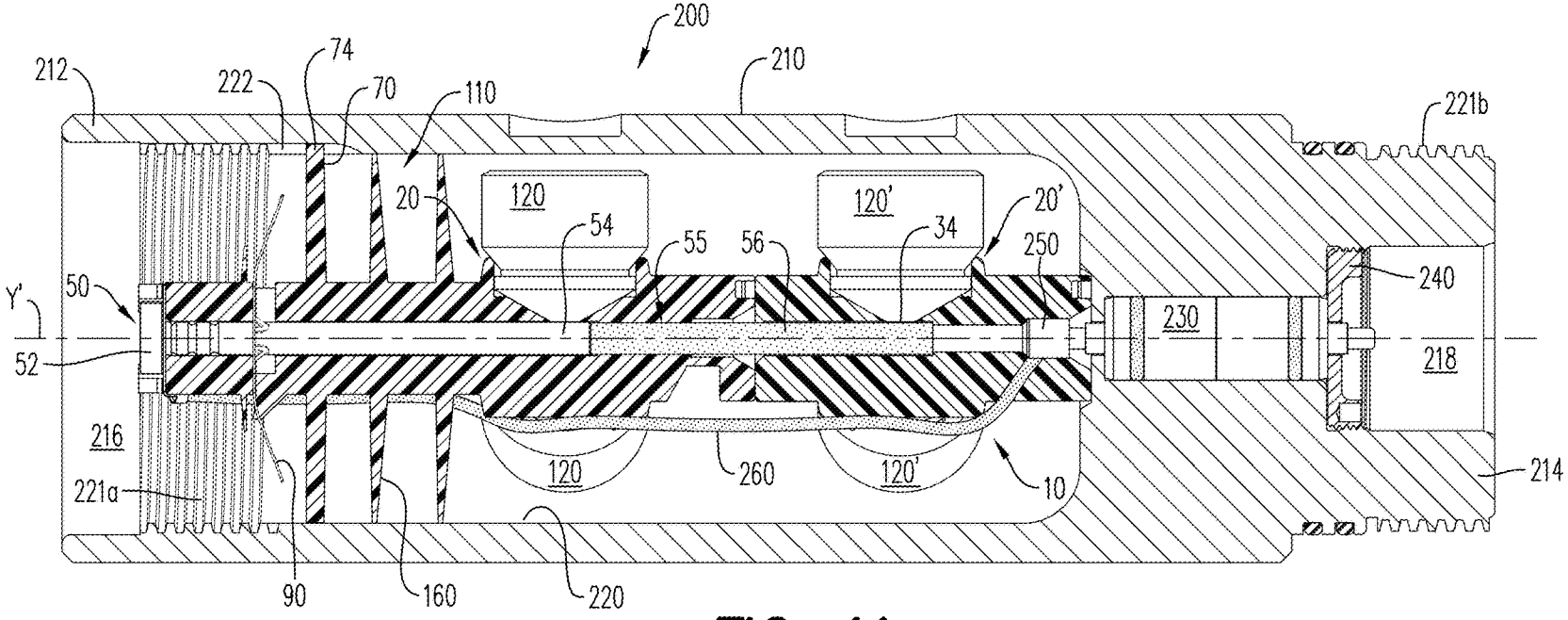
FIG. 11 is a partial cross-sectional, side view of a perforating gun module including a positioning device and a detonator positioned in the first positioning device and an adjacent positioning device including a detonation extender, according to an embodiment.

The elongated cavity 40 may be configured for receiving and retaining a detonative device therein. According to an aspect, the detonative device includes a detonator 50 (FIG. 11). The detonator 50 may be positioned centrally within the shaped charge holder 20. According to an aspect and as illustrated in FIG. 6, the plurality of shaped charges 120 housed in the shaped charge holder 20 includes an open front end 320 and a back wall 330 having an initiation point 331 extending therethrough. The detonator 50 is substantially adjacent the initiation point 331 and is configured to simultaneously initiate the shaped charges 120 in response to an initiation signal, such as a digital code.

According to an aspect, the detonator 50 is a wireless push-in detonator. Such detonators are described in U.S. Pat. Nos. 9,605,937 and 9,581,422, both commonly owned and assigned to DynaEnergetics GmbH & Co KG, each of which is incorporated herein by reference in its entirety. According to an aspect, the detonator 50 includes a detonator head 52 and a detonator body 54 (FIG. 11) extending from the detonator head 52. The detonator head 52 includes an electrically contactable line-in portion, an electrically contactable line-out portion, and an insulator positioned between the line-in and line-out portions, wherein the insulator electrically isolates the line-in portion from the line-out portion. The detonator body 54 may be energetically coupled to or may energetically communicate with each of the shaped charges 120. According to an aspect, the detonator body 54 may include a metal surface, that provides a contact area for electrically grounding the detonator 50.

Figure 9:
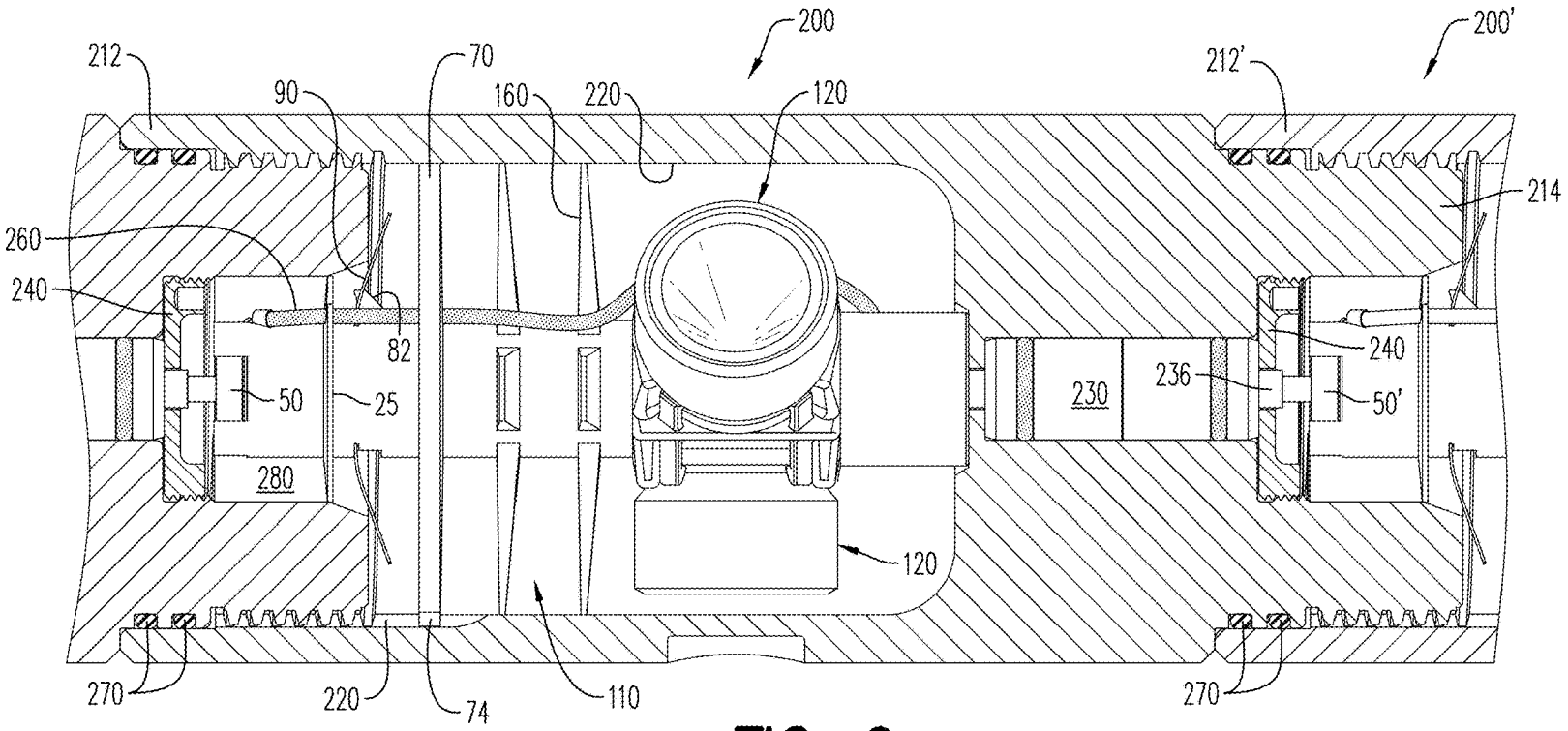
FIG. 9 is a partial cross-sectional, side view of the perforating gun module of FIG. 8, illustrating a through wire extending from a detonator to a bulkhead assembly.

The positioning device 10 may include passageways 28 that help to guide a feed through/electrical wire 260 (FIG. 9) from the detonator 50 to contact a bulkhead assembly/pressure bulkhead assembly 230 (FIG. 9). As illustrated in FIGS. 1-2 and FIG. 11, the passageway 28 may be formed at the second end 24 of the positioning device 10 and receives and guides the feed through wire/electrical wire 260 to the bulkhead assembly 230.

Figure 4:
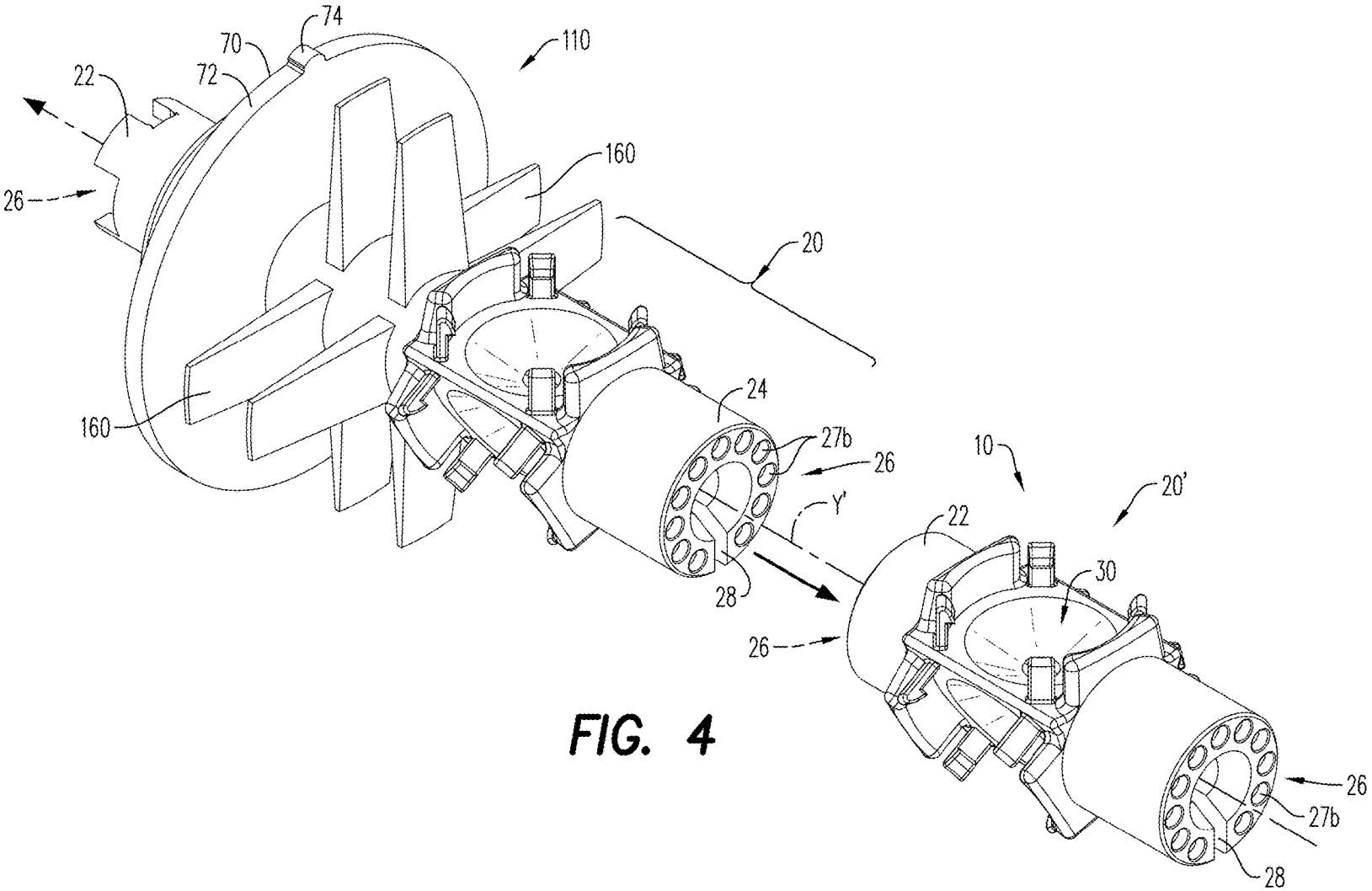
FIG. 4 is side, perspective view of the positioning device of FIG. 3 for being attached to the positioning device of FIG. 1.

The positioning device 10 may be configured as a modular device having a plurality of connectors 26 that allows the positioning device 10 to connect to other adjacent positioning devices, adjacent shaped charge holders, and spacers, as illustrated in FIG. 4. The positioning device 10 may be configured to engage or connect to charge holders, spacers and connectors described in U.S. Pat. Nos. 9,494,021 and 9,702,680, both commonly owned and assigned to DynaEnergetics GmbH & Co KG, each of which is incorporated herein by reference in its entirety.

The connectors 26 each extend along the central Y-axis of the shaped charge holder 20. According to an aspect, the connectors 26 includes at least one of a plurality of plug connectors/pins **27*a* and a plurality of receiving cavities/sockets 27*b*. The plurality of receiving cavities/sockets 27*b* are shown in FIG. 1 and FIG. 2 on the opposite end of the positioning device 10, for receiving plug connectors 27*a* from a downstream positioning device. The plug connectors 27*a* outwardly extend from the first or second end 22, 24, and the receiving cavities 27*b* inwardly extend into the positioning device 10 from the first or second end 22, 24. The plug connectors 27*a* are configured for being inserted and at least temporarily retained into the receiving cavities 27***b* of the adjacent positioning device, shaped charge holder, spacer or other connectors, while the receiving cavities 27*b* are configured to receive plug connectors 27*a* of another adjacent positioning device, charge holder, spacer or other components. When the first end 22 includes plug connectors 27*a*, the second end 24 includes receiving cavities 27*b* that are configured to receive and retain the plug connectors of the adjacent positioning device, charge holder, spacer or other components. According to an aspect, the plug connectors 27*a* are mushroom-shaped, which may aid in the retention of the plug connectors 27*a* in the receiving cavities.

Further embodiments of the disclosure are associated with a positioning device 110, as illustrated in FIGS. 3-5 and 8-11. The positioning device 110 includes a first end 22 and a second end 24. According to an aspect, the first end 22 of the positioning device 110 may be contoured to retain a detonator head 52 (FIG. 8 and FIG. 12B) therein. A shaped charge holder 20 extends between the first and second ends 22, 24 of the positioning device 110. For purposes of convenience, and not limitation, the general characteristics of the shaped charge holder 20 applicable to the positioning device 110, are described above with respect to the FIGS. 1-2, and are not repeated here.

Figure 3:
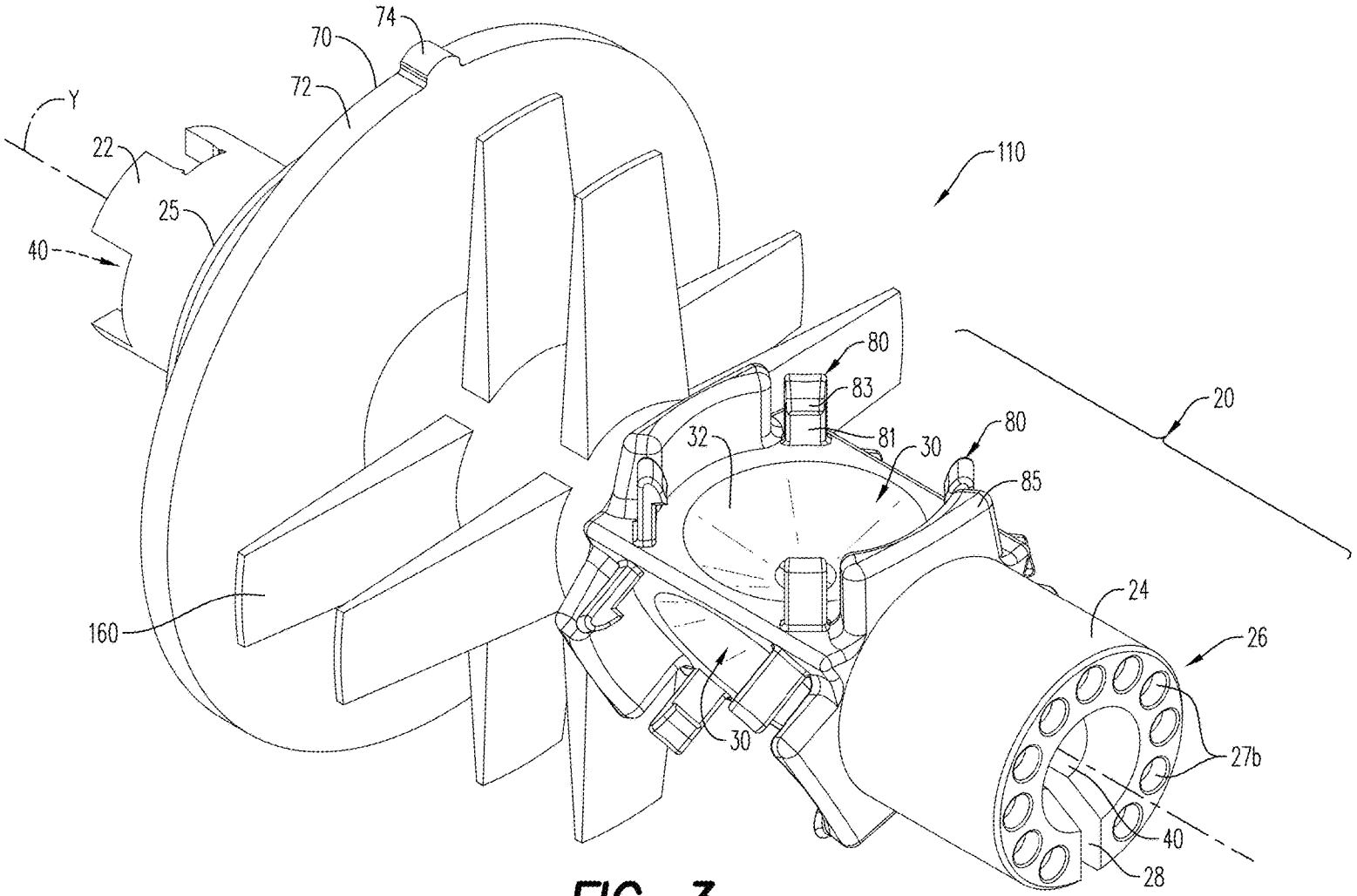
FIG. 3 is a side, perspective view of a positioning device including a plurality of ribs and a plate, according to an embodiment.

Similar to the shaped charge holder described hereinabove with reference to FIGS. 1-2, the shaped charge holder 20 illustrated in FIG. 3 includes a plurality of shaped charge receptacles 30, a plurality of retention mechanisms 80 and a plurality of positioning blocks 85, which are configured substantially as described hereinabove with respect to FIGS. 1-2. Thus, for purpose of convenience, and not limitation, the features and characteristics of the receptacles 30, the retention mechanisms 80 and the positioning blocks 85 of the positioning block 110 are not repeated here.

The positioning device 110 further includes an elongated cavity/lumen 40 extending through a length of the positioning device 110. The elongated cavity 40 extends from the first end 22 to the second end 24, adjacent each of the shaped charge receptacles 30, and is configured for receiving and retaining a detonator 50.

Figure 10:
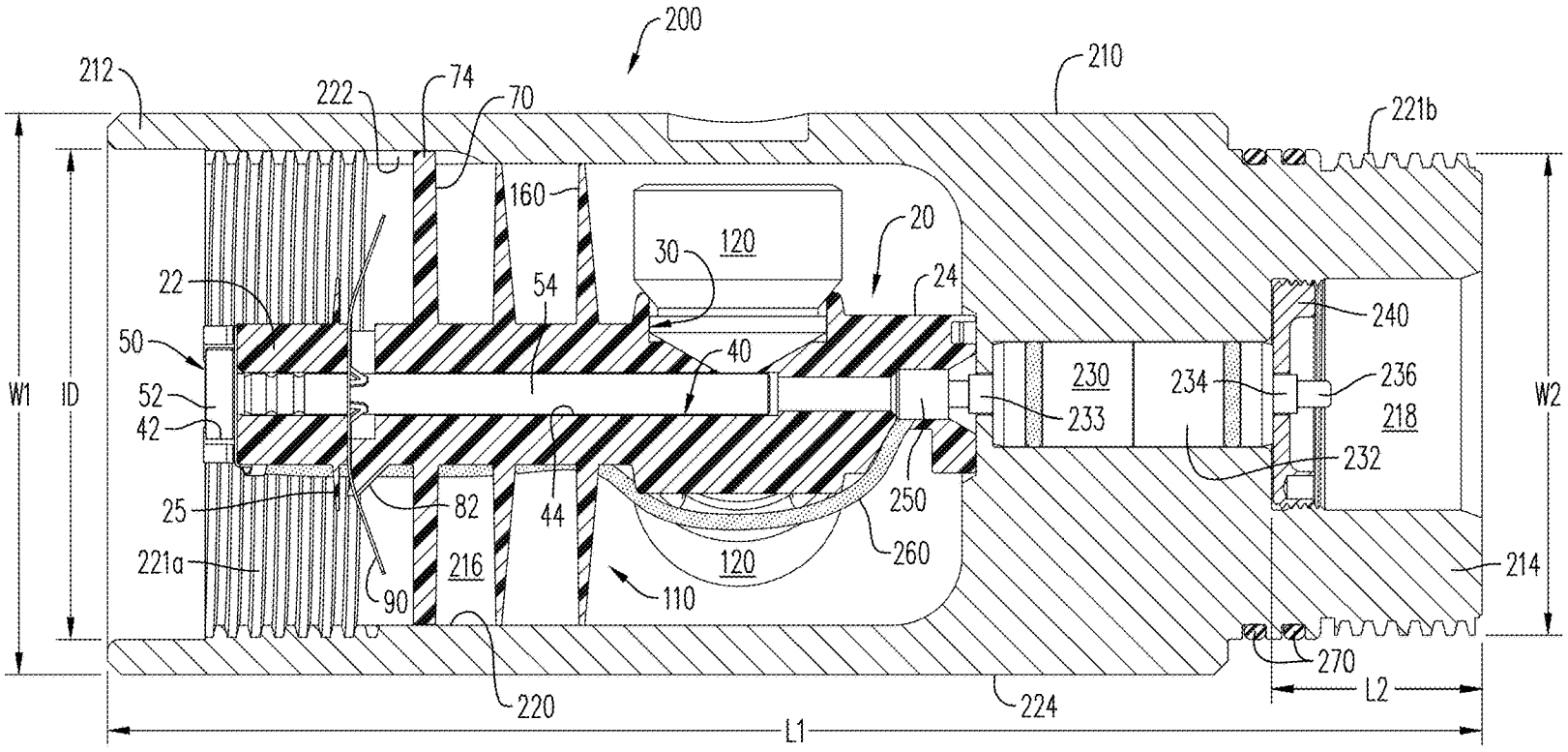
FIG. 10 is a partial cross-sectional, side view of a perforating gun module including a positioning device and a detonator positioned therein, according to an embodiment.

FIG. 10 illustrates the detonator 50 positioned in the elongated cavity 40. The detonator 50 is configured to initiate the shaped charges 120 simultaneously in response to an initiation signal. As described hereinabove, the detonator 50 may be a wireless push-in detonator. The detonator 50 of the positioning device 110 may be configured substantially as the detonator 50 of the positioning device 10 described hereinabove with respect to FIGS. 1-2, thus for purposes of convenience and not limitation, the various features of the detonator 50 for the positioning device 10 are not repeated hereinbelow.

The detonator 50 of the positioning device 110 includes a detonator head 52 and a detonator body 54 is energetically coupled to each of the shaped charges 120. The elongated cavity 40 may be stepped or contoured to receive the head 52 and body 54 of the detonator 50. According to an aspect and as illustrated in FIG. 10, the elongated cavity 40 includes a first cavity 42 and a second cavity 44 extending from the first cavity 42. The first cavity 42 extends from and is adjacent the first end 22 of the positioning device 110, while the second cavity 44 extends from the first cavity 42 towards the second end 24. The first cavity 42 is larger than the second cavity 44 and is configured for receiving the detonator head 52, while the second cavity 44 is configured for receiving the detonator body 54.

According to an aspect, the positioning device 110 may be equipped with means for maintaining the positioning device in a preselected position in a perforating gun module 200. The positioning device 110 may include at least one rib/fin 160 outwardly extending from the positioning device 110. FIG. 3 illustrates ribs 160 radially extending from the positioning device 110 and being arranged between the first end 22 of the positioning device 110 and the shaped charge holder 20. The ribs 160 may be substantially equal in length with each other and may be configured to engage with an interior surface of a perforating gun module 200, as illustrated in, for example, FIGS. 8-11.

The positioning device 110 may further include a plate 70 at least partially extending around the positioning device 110. The plate 70 may be disposed/arranged between the first end 22 and the rib 160. FIG. 3 illustrates a protrusion/anti-rotation key 74 extending from a peripheral edge 72 of the plate 70. The protrusion 74 may be configured to secure the positioning device 110 within a perforating gun module 200, and to prevent rotation of the positioning device 110 and the shaped charge holder 20 within the perforating gun module 200. As illustrated in FIGS. 8-11 and FIG. 12B, the protrusion 74 may be configured to engage with an inner surface 220 (or a slot 222) of a housing 210 of the perforating gun module 200, which helps ensure that the shaped charges 120 are maintained in their respective positions with respect to the perforating gun module 200. According to an aspect, the plate 70 is sized and dimensioned to capture debris resulting from detonation of the plurality of shaped charges 120. As illustrated in FIG. 3, the plate 70 has a larger surface area than the ribs 160, such that it is able to collapse with at least one of the shaped charge holder 20 and the ribs 160, and capture any debris generated by the detonation of the shaped charges 120, thereby reducing the amount (i.e., number of individual debris) that may need to be retrieved from the wellbore.

Figure 8:
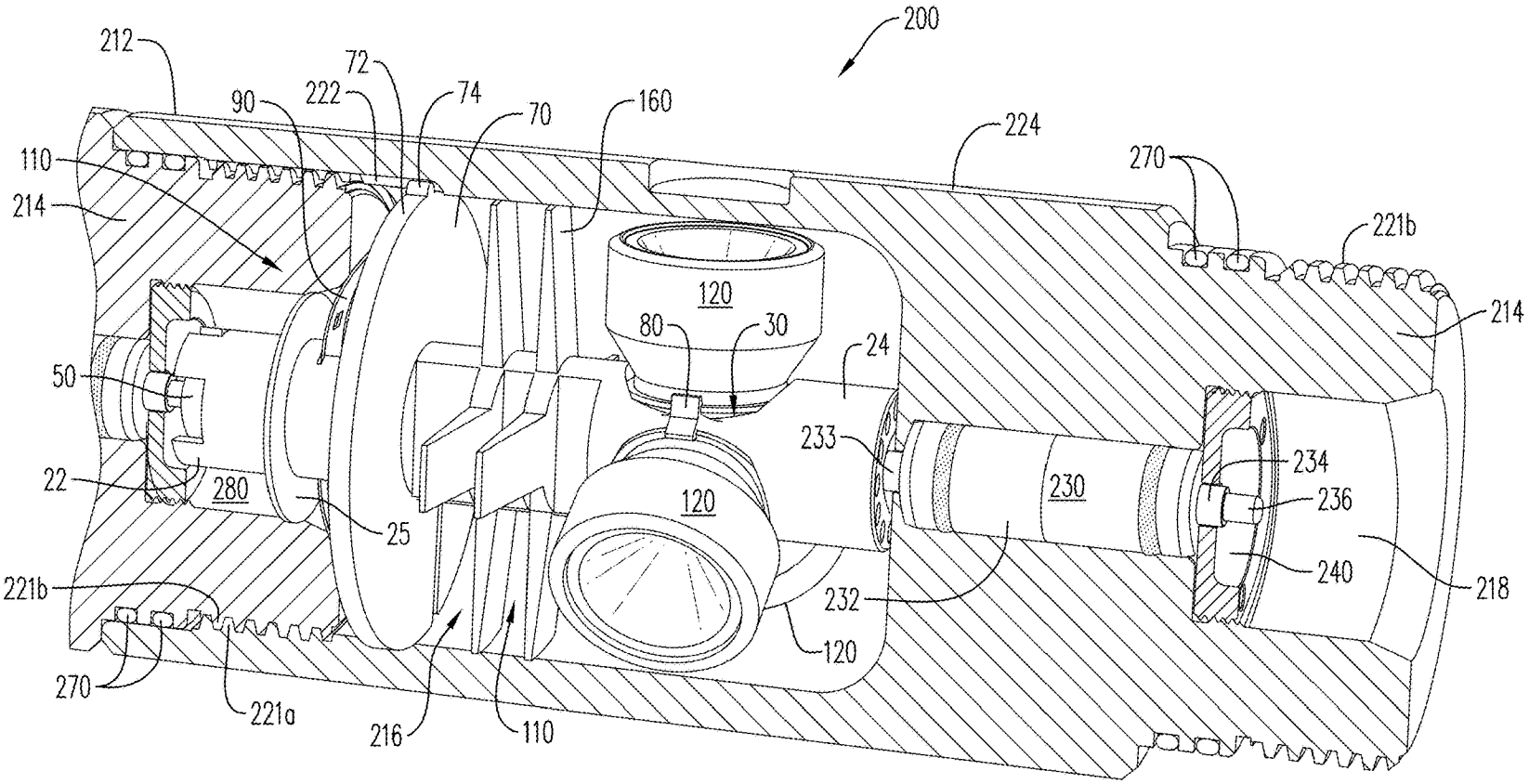
FIG. 8 is a partial cross-sectional and perspective view of a perforating gun module, illustrating a positioning device therein, according to an aspect.

The positioning device 110 further includes a disk 25 outwardly and circumferentially extending from the positioning device 110. The disk is arranged between the first end 22 and the plate 70 and, as illustrated in FIG. 8 and FIG. 9, may help to create an isolation chamber 280 for the detonator head 52. The isolation chamber 280 may protect and isolate the detonator 50 from lose metallic particles, shards, machine metal shavings and dust, or substantially minimize the detonator head 52 from such exposure, that may negatively impact the functionality of the detonator 50 and cause an electrical short circuit in the system.

According to an aspect, one or more components of the positioning device 110 may be configured with a passageway 28. The passageway 28 may formed in at least one of the disk 25 (FIG. 12B), the plate 70 (FIG. 12B) and the second end 24 (FIG. 304) of the body 20. The passageway 28 receives and guides a feed through wire/electrical wire 260 from the detonator 50 to the second end of the positioning device 110, wherein the wire 260 contacts a bulkhead assembly/rotatable bulkhead assembly 230.

Figure 14:
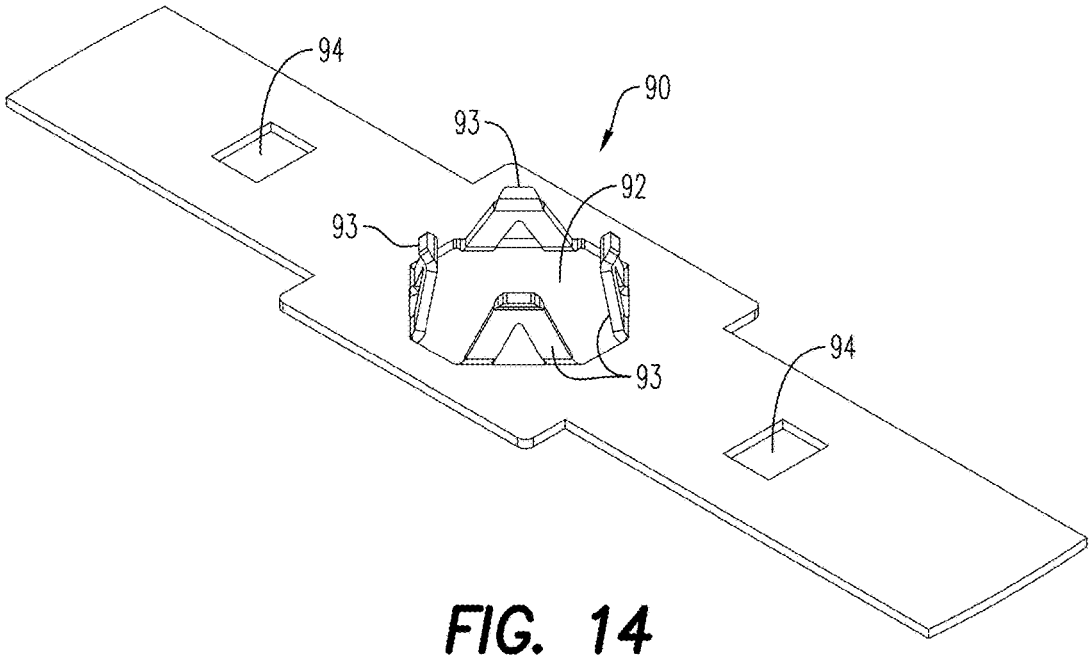
FIG. 14 is a perspective view of a ground bar couplable to a positioning device, according to an embodiment.

As illustrated in FIGS. 8-11 and FIG. 12B, a ground bar 90 may be arranged on or otherwise coupled to the positioning device 110. The ground bar 90 is secured to the positioning device 110, between the first end 22 and the plate 70. According to an aspect, a support member 82 extends from the positioning device 110, between the ground bar 90 and the plate 70. The support member 82 is configured to prevent movement of the ground bar 90 along the central Y-axis of the shaped charge holder 20, to ensure that the ground bar 90 is able to contact a portion of an adjacent perforating gun module. FIG. 14 shows the ground bar 90 in more detail. The ground bar 90 may include a centrally-arranged opening 92 having a plurality of engagement mechanisms 93, and one of more slots 94 to facilitate the ground bar 90 being secured to the positioning device 110 and to facilitate the engagement of the ground bar 90 with the adjacent perforating gun module. According to an aspect, the ground bar 90 is formed from a stamped, laser cut, or water-jet cut sheet of metal. The ground bar 90 may be formed from at least one of stainless steel, brass, copper, aluminum or any other electrically conductive sheeted material which can be stamped and re-worked, water jet cut or laser cut.

Figure 17:
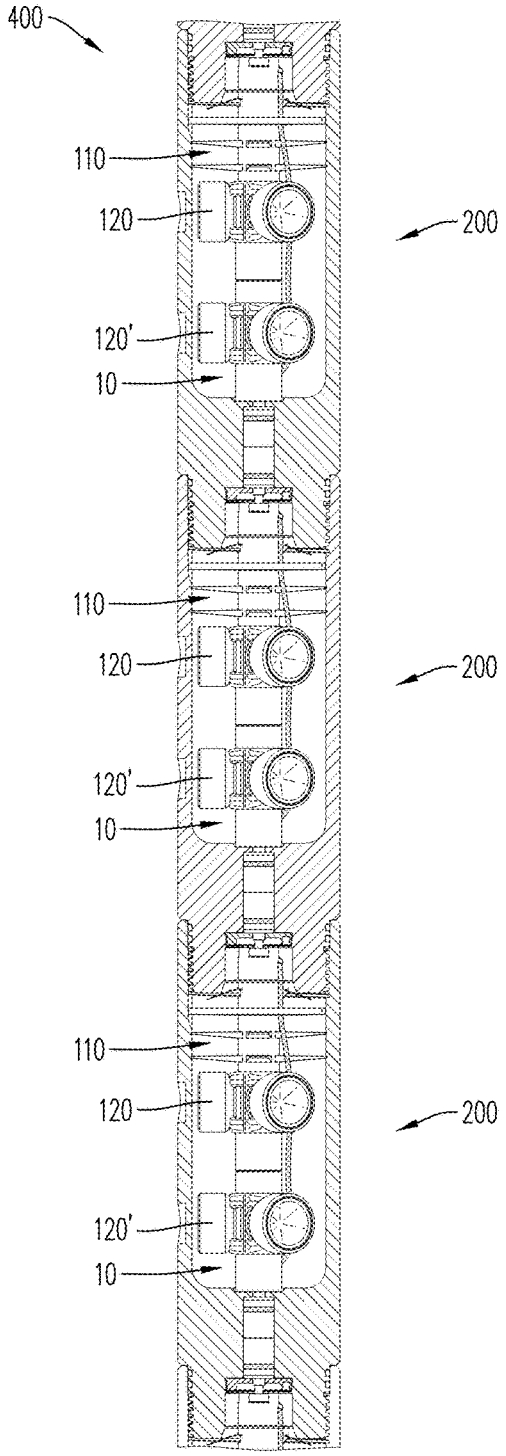
FIG. 17 is a side, partial cross-sectional and perspective view of the string of the perforating gun modules configured according to FIG. 11.

According to an aspect, and as illustrated in at least FIGS. 4, 11, and 17, the positioning device 110 may be connectable to adjacent devices or components of a perforating gun module 200. In an embodiment, at least one of the first end 22 and the second end 24 includes a plurality of connectors 26 extending along the central Y-axis of the charge holder 20. The connectors 26 provide for a modular connection between the positioning device 110 and at least one of an adjacent positioning device, an adjacent shaped charge holder and a spacer including corresponding connectors. The connectors 26 of the positioning device 110 may be configured substantially as the connectors 26 of the positioning device 10 described hereinabove with respect to FIGS. 1-2, thus for purposes of convenience and not limitation, the various features of the connectors 26 of the positioning device 10 are not repeated here.

In an embodiment and as shown in FIG. 11, the shaped charges 120 is a first set of shaped charges, and a second set of shaped charges 120' is supported in a separate shaped charge holder 20' connected to the positioning device 110. The separate shaped charge holder 20' may be included in the positioning device 10 illustrated in FIGS. 1-2. The separate shaped charge holder 20' includes a plurality of shaped charge receptacles 30 extending between first and second ends 22, 24 of the separate shaped charge holder 20'. The receptacles 30 are radially arranged in an XZ-plane about a central Y-axis of the separate shaped charge holder 20', each receptacle 30 retaining one of the shaped charges 120'.

Figure 13A:
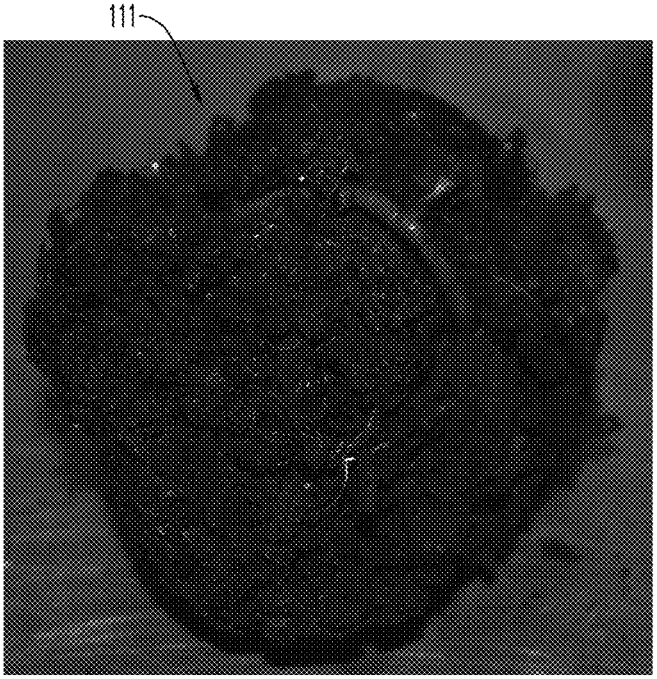
FIG. 13A is a perspective view of a resulting mass formed from the detonation of shaped charges positioned in a positioning device, according to an aspect.

An elongated cavity 40 extends from the first end 22 to the second end 24 of the separate shaped charge holder 20' and is configured for retaining a detonation extender 55 therein. According to an aspect, the detonation extender 55 includes a detonating cord or a booster device 56. As illustrated in FIG. 11, when the positioning device 110 is connected to the separate shaped charge holder 20', the detonation extender 55 is configured to abut an end of the detonator body 54 and extend from the elongated opening 40 of the positioning device 110 into the elongated opening 40 of the separate shaped charge holder 20' so the detonator extender is adjacent initiation points 331 of the separate shaped charges 120'. The detonation extender 55 is adjacent a plurality of openings 34 formed in the shaped charge receptacles of the separate shaped charge holder 20'. When the detonator 50 is activate, a detonation energy from the detonator 50 simultaneously activates the shaped charges 120 of the first set of shaped charges and the detonation extender 55. The detonation extender 55 thereafter generates a detonation wave, which simultaneously activates the second set of shaped charges 120'. Once all the charges 120, 120' have detonated, the positioning device 110 and the separate charge holder 20' forms a resulting mass 111 (FIGS. 13A-13B) and limits the amount of debris generated upon detonation of the shaped charges.

According to an aspect, the shaped charges 120 for use with the aforementioned positioning devices 10/110 illustrated in FIGS. 1-5 may be specially configured to be secured in a shaped charge holder 20/20' (collectively shaped charge holder 20) described hereinabove. According to an aspect and as illustrated in FIG. 6, a shaped charge 120 for use at least one of a positioning device 110 and a shaped charge holder 20) includes a substantially cylindrical/conical case 310. The conical case 310 includes an open front end 320, a back wall 330 having an initiation point 331 extending therethrough, and at least one cylindrical side wall 340 extending between the open front end 320 and the back wall 330.

The shaped charge 120 further includes a cavity 322 defined by the side wall 340 and the back wall 330. An explosive load 324 is disposed within the cavity 322. According to an aspect, the explosive load 324 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), triaminotrinitrobenzol (TATB), and PTB (mixture of PYX and TATB). According to an aspect, the explosive load 324 includes diamino-3,5-dinitropyrazine-1-oxide (LLM-105). The explosive load may include a mixture of PYX and triaminotrinitrobenzol (TATB). The type of explosive material used may be based at least in part on the operational conditions in the wellbore and the temperature downhole to which the explosive may be exposed.

As illustrated in FIG. 6, a liner 326 is disposed adjacent the explosive load 324. The liner 326 is configured for retaining the explosive load 324 within the cavity 322. In the exemplary embodiment shown in FIG. 6, the liner 326 has a conical configuration, however, it is contemplated that the liner 326 may be of any known configuration consistent with this disclosure. The liner 326 may be made of a material selected based on the target to be penetrated and may include, for example and without limitation, a plurality of powdered metals or metal alloys that are compressed to form the desired liner shape. Exemplary powdered metals and/or metal alloys include copper, tungsten, lead, nickel, bronze, molybdenum, titanium and combinations thereof. In some embodiments, the liner 326 is made of a formed solid metal sheet, rather than compressed powdered metal and/or metal alloys. In another embodiment, the liner 326 is made of a non-metal material, such as glass, cement, high-density composite or plastic. Typical liner constituents and formation techniques are further described in commonly-owned U.S. Pat. No. 9,862,027, which is incorporated by reference herein in its entirety to the extent that it is consistent with this disclosure. When the shaped charge 120 is initiated, the explosive load 324 detonates and creates a detonation wave that causes the liner 326 to collapse and be expelled from the shaped charge 120. The expelled liner 326 produces a forward-moving perforating jet that moves at a high velocity According to an aspect, the cylindrical side wall portion 340 includes a first wall 342 outwardly extending from a flat surface 332 of the back wall 330, a second wall 344 outwardly extending from the first wall 342, and a third wall 346 upwardly extending from the second wall 344 towards the open front end 320. The third wall 346 may be uniform in width as it extends from the second wall 344 to the open from end 320.

An engagement member 350 outwardly extends from an external surface 341 of the side wall 340. As illustrated in FIG. 6, the engagement member 350 extends from the first wall 342, at a position adjacent the second wall 344. As illustrated in FIG. 5, the engagement member 350 may be configured for coupling the shaped charge 120 within a shaped charge holder 20 of a positioning device 10/110. In an embodiment, at least one of the first wall 342 and the second wall 344 includes a groove/depression 352 circumferentially extending around the side wall 340. The groove 352 extends inwardly from the side wall 340 of the case 310 towards the cavity 322. The groove (352 may be configured to receive one or more retention mechanisms 80 of the positioning device 10/110 or the shaped charge holder 20, thereby securedly fastening the shaped charge 120 to the positioning device 10/110 or the shaped charge holder 20.

According to an aspect, the size of the shaped charge 120 may be of any size based on the needs of the application in which the shaped charge 120 is to be utilized. For example, the conical case 310 of the shaped charge 120 may be sized to receive from about 3 g to about 61 g of the explosive load 324. As would be understood by one of ordinary skill in the art, the caliber/diameter of the liner 326 may be dimensioned based on the size of the conical case 310 and the explosive load 324 upon which the liner 326 will be disposed. Thus, even with the use of three (3) shaped charges in the positioning device 10/110 (i.e., a three-shot assembly), the arrangement of the shaped charges 120 in the positioning device 10/110, in combination with adjusting the size of the shaped charges 120, may provide the equivalent shot performance (and provide equivalent fluid flow) of a typical assembly/shot carrier having 4, 5, 6 shaped charges.

Embodiments of the disclosure are further associated with a perforating gun module 200. The perforating gun module 200 includes a housing/sub assembly/one-part sub 210 formed from a preforged metal blank/shape. The housing 210 may include a length L1 of less than about 12 inches, alternatively less than about 9 inches, alternatively less than about 8 inches. According to an aspect, the length of the housing 210 may be reduced because the perforating gun module 200 does not require the use of separate tandem sub adapters to connect or seal a plurality of perforating gun modules 200.

The housing 210 includes a first housing end 212, a second housing end 214, and a chamber 216 extending from the first housing end 212 towards the second housing end 214. The housing 210 may be configured with threads to facilitate the connection of a string of perforating gun modules 200 together. According to an aspect, an inner surface 220 of the housing 210 at the first housing end 212 includes a plurality of internal threads 221*a*, while an outer/external surface 224 of the housing 210 includes a plurality of external threads 221*b* at the second housing end 214. A plurality of housings 210 may be rotatably connected to each other via the threads 221, 221*b*. A plurality of sealing mechanisms, such as o-rings 270, may be used to seal the housing 210 of the perforating gun 200 from the contents of the housing of an adjacent perforating gun, as well as from the outside environment (fluid in the wellbore) from entering the chamber 216.

As illustrated in FIG. 10, the first housing end 212 has a first width W1, the second housing end 214 has a second width W2, and the chamber 216 has an internal diameter ID. The second width W2 may be less than the first width W1, and the internal diameter ID of the chamber 216 may be substantially the same as the second width W2. As illustrated in FIG. 9, for example, the second housing end 214 of the housing 210 of the perforating gun 200 may be rotatably secured within the first housing end 212 (i.e., in the chamber) of the housing of an adjacent perforating gun 200'. According to an aspect, the second housing end 214 is configured to be secured within a chamber of an adjacent perforating gun assembly 200', and the first housing end 212 is configured to secure a second housing end of another adjacent perforating gun module.

According to an aspect, one or more positioning devices 10/110 may be secured in the chamber 216 of the housing 210. The positioning device 10/110 may be configured substantially as described hereinabove and illustrated in FIGS. 1-5. Thus, for purposes of convenience, and not limitation, the features and functionality of the positioning device 10/110 are not repeated in detail herein below.

As illustrated in FIGS. 8-10 and according to an aspect, the first end 22 of the positioning device 110 is adjacent the first housing end 212. The rib 160 of the device 110 engages with an inner surface 220 of the housing 210, within the chamber 216, thereby preventing the device from moving upwardly or downwardly in the chamber 216.

Figure 7:
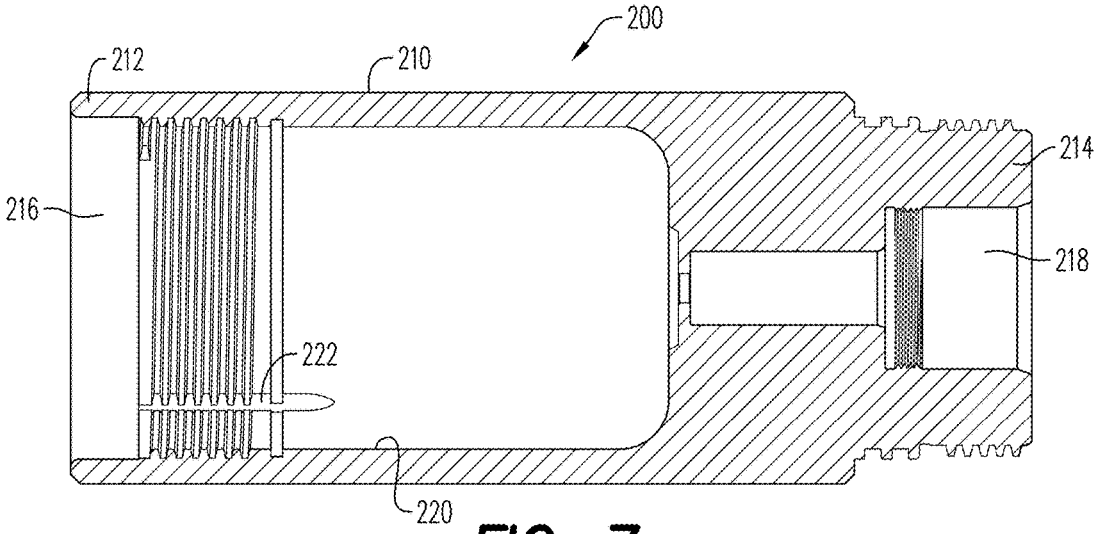
FIG. 7 is a cross-sectional view of a housing of a perforating gun module, according to an aspect.
Figure 12A:
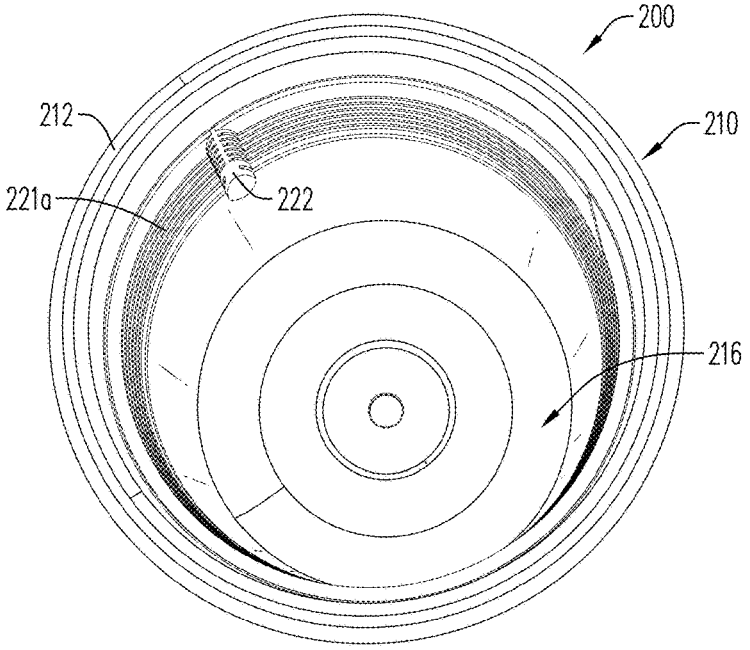
FIG. 12A is a top down view of a housing of a perforating gun module, according to an embodiment.
Figure 12B:
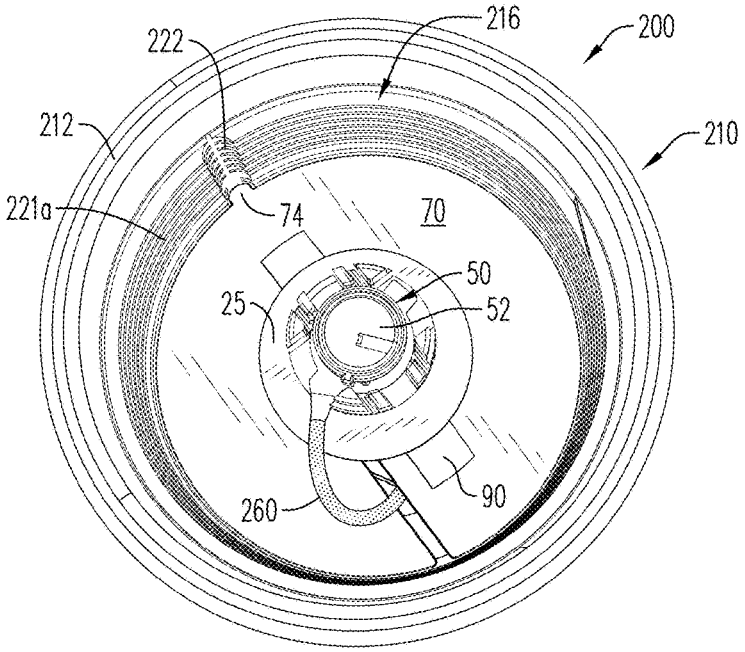
FIG. 12B is a top down view of the perforating gun module of FIG. 12A, illustrating a positioning device therein.
Figure 13B:
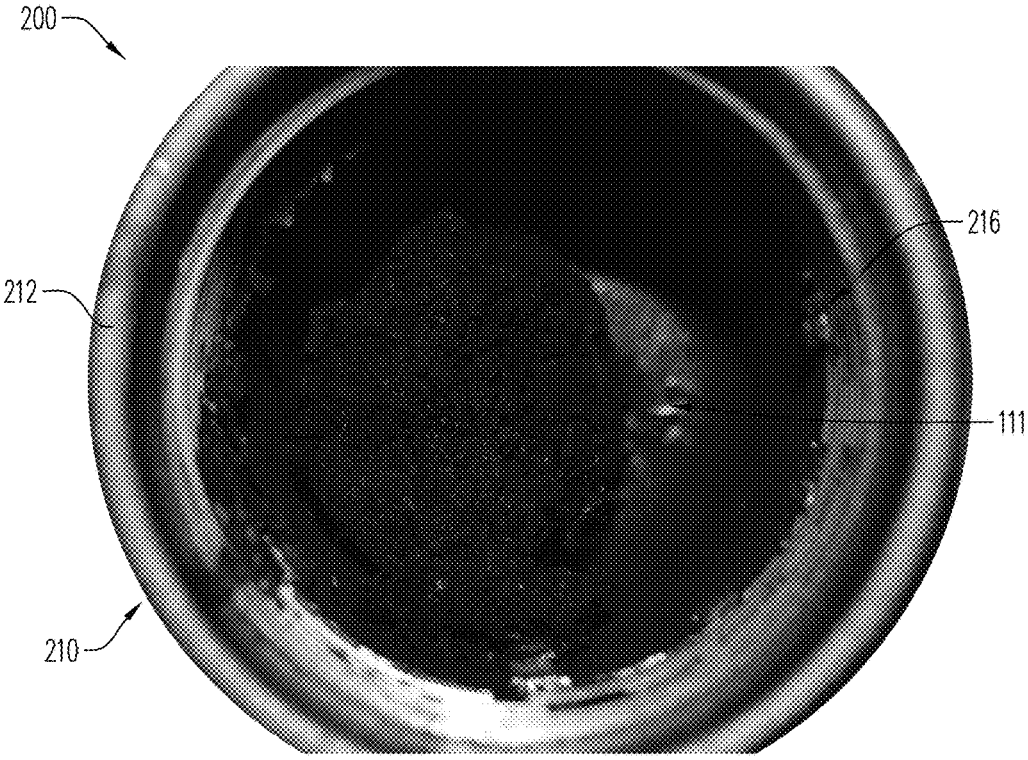
FIG. 13B is a top down view of the perforating gun module of FIG. 12B, illustrating a resulting mass formed upon detonation of the shaped charges positioned in the positioning device.

As illustrated in FIGS. 8-11, a plate 70 of the positioning device 110 helps to further secure the positioning device 110 in the housing 210. The plate 70 includes a protrusion 74 extending from a peripheral edge 72 of the plate 70. As illustrated in FIGS. 12A-12B, the protrusion 74 may be seated in a slot 222 formed in an inner surface 220 of the housing 210. FIG. 7 illustrates the slot extending from the first housing end 212 into the chamber 216. The protrusion 74 of the plate 70 engages the slot 222 to secure the positioning device 110 within the perforating gun 200 and prevent unwanted rotation of the positioning device 110, and thus the shaped charge holder 20, within the perforating gun module 200. As described hereinabove, upon detonation of the shaped charges 120, the plate 70 and the shaped charge holder 20 is configured to capture debris resulting from detonation of the shaped charges 120. The captured debris, the plate 70 and the shaped charge holder 20 forms a mass/resulting mass 111 (FIG. 13A) upon the detonation of the charges 120. As seen in FIG. 13B, the resulting mass 111 is retained in the chamber 216 of the housing 210. The resulting mass 111 includes shrapnel and debris created upon the detonation of the shaped charges, as well as any additional wires (e.g. through wire 260) or components previously placed or housed in the housing 210.

The housing 210 further includes a recess/mortise 218 extending from the second housing end 214 towards the chamber 216. The recess 218 partially tapers from the second housing end 214 towards the chamber 216 and is configured to house the detonator head 52 of a detonator 50 of an adjacent positioning device 110. As illustrated in FIG. 9, for example, the disk 25 of the positioning device 110 of an adjacent perforating gun 200 covers a portion of the recess 218, thereby forming an isolation chamber 280 for the detonator head 52. According to an aspect, when the housing 210 includes a length L1 of less than about 8 inches, the recess 218 may include a length L2 of less than about 2 inches.

A bulkhead assembly 230 may be positioned between the chamber 216 (i.e., adjacent the second end 24 of the positioning device 110) and the recess 218. According to an aspect, the bulkhead assembly 230 is a rotatable bulkhead assembly. Such bulkhead assemblies are described in U.S. Pat. No. 9,784,549, commonly owned and assigned to DynaEnergetics GmbH & Co KG, which is incorporated herein by reference in its entirety.

The bulkhead assembly includes a bulkhead body 232 having a first end 233 and a second end 234. A metal contact plug/metal contact 250 is adjacent the first end 233 of the bulkhead body 232 and a downhole facing pin 236 extends from a second end 234 of the bulkhead body 232. The perforating gun module 200 further includes a feed through wire 260 extending from the detonator 50 to the metal contact plug 250 via the line-out portion of the detonator head 52. The metal contact plug 250 is configured to secure the feed through wire 260 to the first end 233 of the bulkhead assembly 230. According to an aspect, the metal contact plug 250 provides electrical contact to the bulkhead assembly 230, while the downhole facing pin 236 is configured to transfer an electrical signal from the bulkhead assembly 230 to a detonator 50' of the adjacent perforating gun module 200'.

FIGS. 8-11 illustrate a collar 240 secured within the recess 218. The collar 240 is adjacent the second end 234 of the bulkhead assembly 230. According to an aspect, the collar 240 includes external threads 242 (FIG. 10) configured for engaging with or being rotatably secured in the recess 218 of the housing 210. When the collar 240 is secured in the recess 218, the bulkhead assembly 230 is also thereby secured in the housing 210.

As illustrated in FIGS. 15, 16A, 16B and 17, when a plurality/a string of perforating gun modules 200 are connected to each other, the ground bars 90 secured to the positioning devices 110 engage with the inner surface 220 housing 210 to provide a secure and reliable electrical ground contact from the detonator 50' (see FIG. 9), and also contacts the second end portion 214 of the adjacent perforating gun modules 200. The support members 82 of each of the positioning devices 110 of the perforating gun modules 200 may prevent movement of the ground bar 90 along the central Y-axis of the shaped charge holder 20 and help to facilitate the contact of the ground bar with the second end portion of the adjacent perforating gun module 200'.

Figure 15:
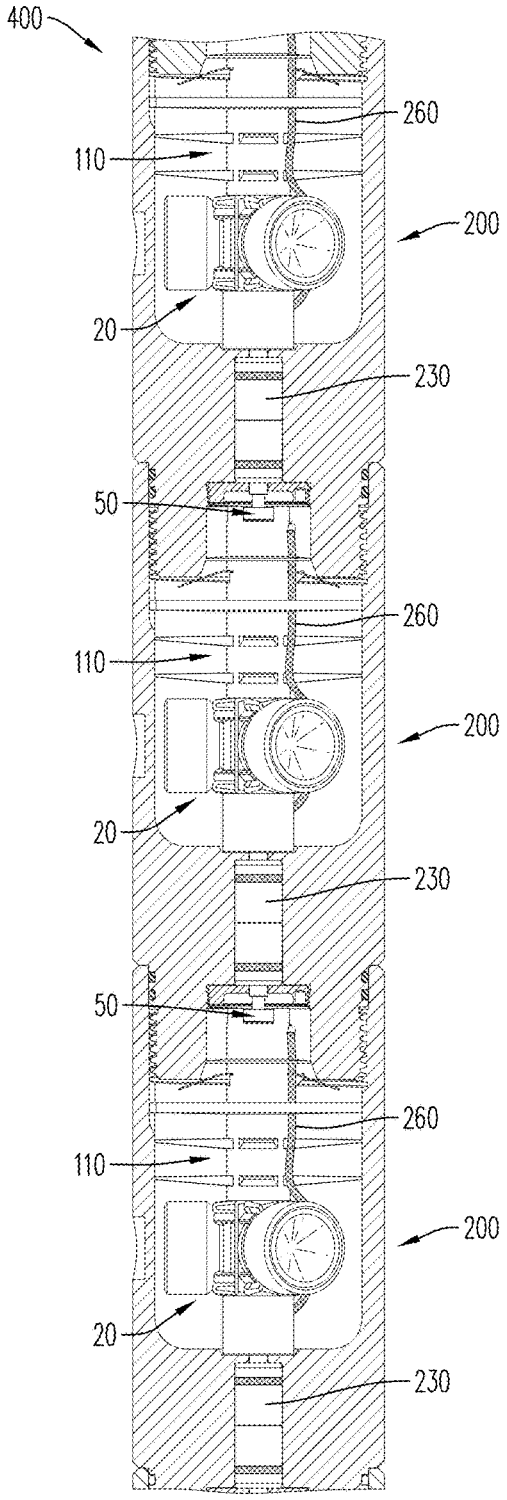
FIG. 15 is a side, partial cross-sectional and perspective view of a string of perforating gun modules, according to an embodiment.
Figure 16A:
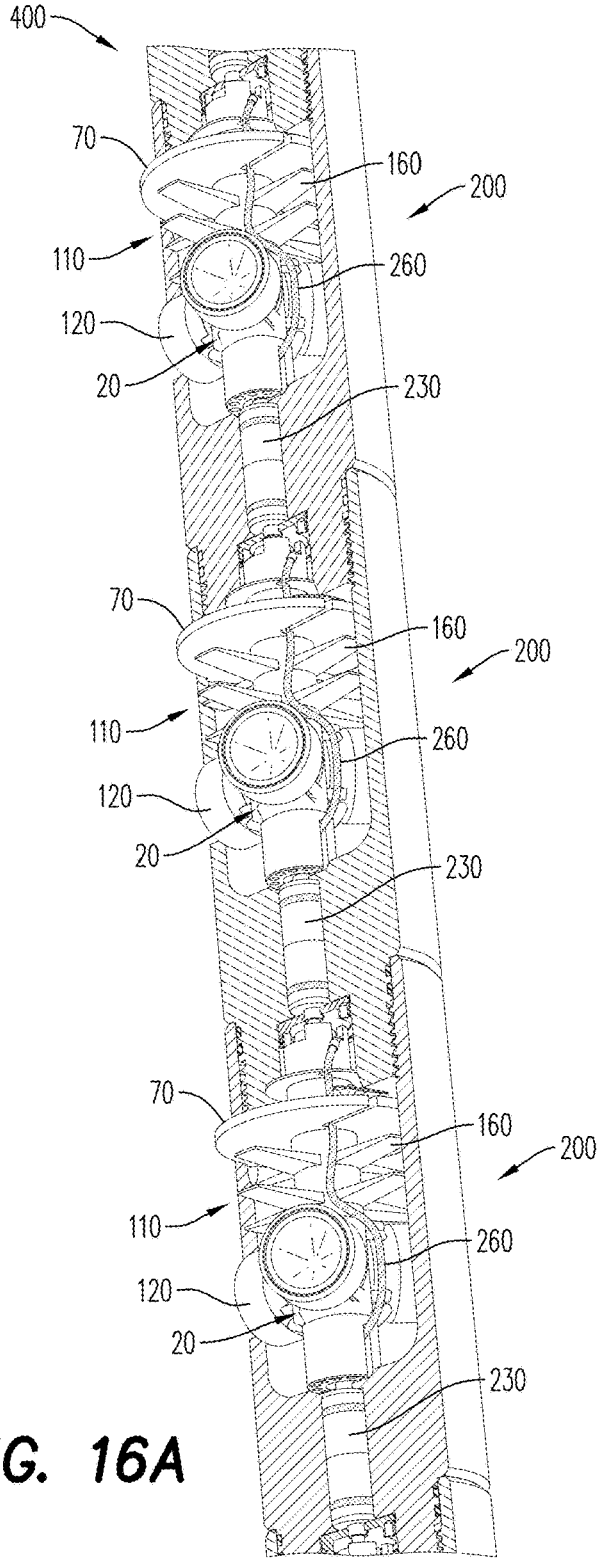
FIG. 16A is a side, partial cross-sectional and perspective view of a string of perforating gun modules configured according to FIG. 10.
Figure 16B:
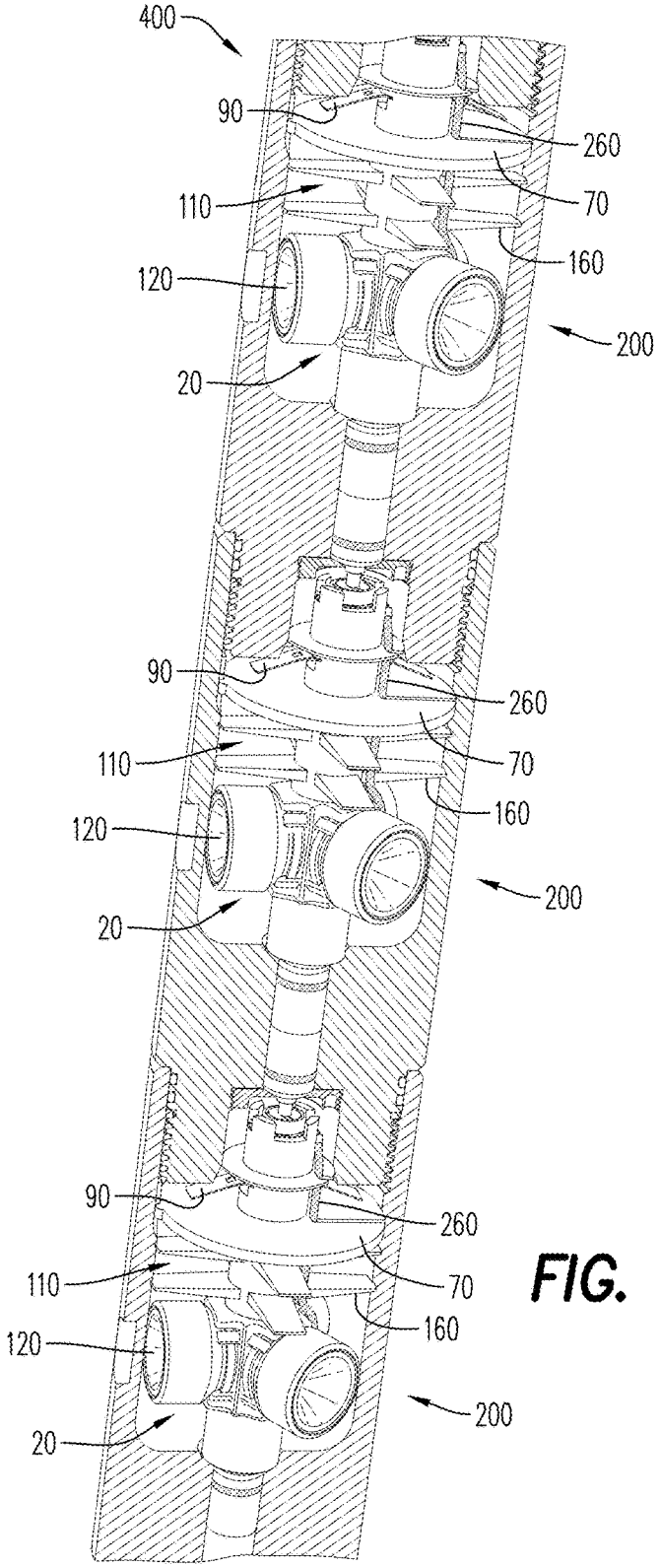
FIG. 16B is a side, partial cross-sectional and perspective view of the string of perforating gun modules of FIG. 16A, illustrating a ground bar positioned in each perforating gun module.

While FIGS. 15, 16A and 16B illustrate the perforating gun modules 200 each including one positioning device 110, it is contemplated that perforating gun modules may be configured to receive more than one positioning device 110, or the positioning device 10 of shaped charge holder 20 described hereinabove with respect to FIGS. 1-2. FIG. 17 illustrates an embodiment in which the positioning device 110 of FIG. 3 is coupled to the positioning device 10 or a separate shaped charge holder 20 of FIGS. 1-2 and are coupled together and secured in a housing 210 of a perforating gun module 200. As described hereinabove with respect to FIG. 11, the elongated cavity 40 of the separate shaped charge holder 20' is retains a detonation extender 55. The detonation extender 55 extends from the elongated opening of the positioning device 110 into the elongated opening of the separate shaped charge holder 20'. The detonation energy from the detonator 50 simultaneously activates the shaped charges 120 of the first set of shaped charges and activates the detonation extender 55, and a detonation wave from the detonation extender 55 simultaneously activates the second set of shaped charges 120' retained in the shaped charge holder 20' or separate positioning device 10.

Embodiments of the disclosure may further be associated with a method of making a perforating gun assembly including a positioning device. The method includes providing a positioning device formed from an injection molded, casted, or 3D printed plastic material or 3-D milled and cut from solid plastic bar stock. The positioning device may be configured substantially as illustrated in FIGS. 1-3. A housing for the perforating gun module is pre-forged from a solid material, such as a block of metal or machinable steel. The block of metal may have a cross-sectional that generally corresponds to the desired cross-sectional shape of the housing. For example, the block of metal may have a cylindrical shape if a cylindrical-shaped housing is desired. According to an aspect, the housing is machined from a solid bar of metal. This requires less metal removal during machining, as compared to typical CNC machining procedures where the body is not pre-forged to a certain shape before machining. This may reduce the time it takes to manufacture the housing and reduces the amount of metal scrap generated during the manufacturing process. The method further includes arranging the positioning device within a chamber of the housing so that the shaped charges are positioned in an XZ-plane, in an outward, radial arrangement, about a central Y-axis of the shaped charge holder.

Embodiments of the disclosure may further be associated with a method of perforating an underground formation in a wellbore using a perforating gun assembly. The method includes selecting/identifying a target shot area for the underground formation. The target shot area may be selected based on a plurality of parameters, such as the desired fluid flow from the formation into the wellbore. The perforating gun assembly includes one or more perforating gun modules including a positioning device having a plurality of shaped charges secured therein. The positioning device is positioned within the chamber of a housing of the module. The positioning device and perforating gun module are configured substantially as described hereinabove with respect to the figures. Thus, for purpose of convenience and not limitation, those features are not repeated here.

The positioning device includes a plurality of shaped charges secured therein. According to an aspect, three shaped charges are positioned in the positioning device. The shaped charges may be arranged in an XZ-plane, in an outward, radial arrangement, about a Y-axis of the shaped charge holder. According to an aspect, the shaped charges are specially designed so that the perforating jets formed upon detonation of the shaped charges has an at least partially altered geometry. At least one of the internal surfaces, the liner geometry and/or liner constituents, and the explosive load of the shaped charges may be modified to change the shape of a perforating jet formed upon detonation of the shaped charges. A detonator is positioned centrally within the shaped charge holder so that it is, or will be, adjacent the initiation points of the shaped charges.

The method further includes positioning the perforating gun assembly in the wellbore adjacent the formation and sending an initiation signal to the detonator. The detonator directly initiates the shaped charges so that they each form a perforating jet. The resulting perforation jets create perforating tunnels in the formation that have the aforementioned altered geometry that facilitates a flow rate or hydraulic fracturing that is equivalent to the flow rate or the hydraulic fracturing typically facilitated by another shaped charge of a different size or composition. The method further includes injecting a fluid into the wellbore to fracture the formation. As described hereinabove, the three shape charges may have a shot performance that is equivalent to that of a traditional shaped charge carrier including 2, 4, 5, 6 or more shaped charges. This may facilitate a cost-effective and efficient way of adjusting the optimal flow path for fluid in the target formation, without modifying the arrangement or quantity of the receptacles of the positioning device.

EXAMPLES

Various perforating gun assemblies, including positioning devices and shaped charges, were made and tested, according to the embodiments of the disclosure. The shaped charges where detonated, and the total average shot area entrance hole diameters presented in the examples shown in Table 1 are based on the minimum and maximum hole diameter formed by the perforation jet upon detonation of the shaped charges.

TABLE 1

| Sample | Shaped Charge Diameter/Caliper (inches) | Shot Count/ Quantity of Shaped Charges | Total Average Shot Area of Perforations (square inches ($in^2$)) |
|---|---|---|---|
| A-1 | 0.35 +/− 0.03 | 2 | 0.19 |
| A-2 | 0.30 +/− 0.03 | 3 | 0.21 |
| B-1 | 0.35 +/− 0.03 | 3 | 0.29 |
| B-2 | 0.35 +/− 0.03 | 3 | 0.29 |
| C-1 | 0.35 +/− 0.03 | 4 | 0.38 |
| C-2 | 0.40 +/− 0.04 | 3 | 0.38 |
| D-1 | 0.35 +/− 0.03 | 5 | 0.48 |
| D-2 | 0.45 +/− 0.05 | 3 | 0.48 |
| E-1 | 0.35 +/− 0.03 | 6 | 0.58 |
| E-2 | 0.50 +/− 0.05 | 3 | 0.59 |

The shaped charges tested (the results of the tests being presented in Table 1), each included a substantially cylindrical/conical case, an explosive load contained in a cavity of the case, and a liner disposed adjacent the explosive load. Samples A-1, B-1, C-1, E-1 and D-1 were each 0.35 inch equal entrance hole shaped charges. In Sample A-1, two (2) shaped charges were arranged in a traditional charge carrier. In Sample B-1, three (3) shaped charges were arranged in a traditional charge carrier. Sample C-1, four (4) shaped charges were arranged in a traditional charge carrier. In Sample D-1, five (5) shaped charges were arranged in a traditional charge carrier. In Sample E-1, six (6) shaped charges were arranged in a traditional charge carrier. In each of Samples A-2, B-2, C-2, D-2 and E-2 three (3) shaped charges were arranged in a positioning device configured substantially as described hereinabove. The shaped charges in Sample A-2 were 0.30 inch equal entrance hole shaped charges, the shaped charges in Sample B-2 were 0.35 inch equal entrance hole shaped charges, the shaped charges in Sample C-2 were 0.40 inch equal entrance hole shaped charges, the shaped charges in Sample D-2 were 0.45 inch equal entrance hole shaped charges, and the shaped charges in Sample E-2 were 0.50 inch equal entrance hole shaped charges. Notably, by adjusting only the size of the three (3) shaped charges utilized in Samples A-2, B-2, C-2, D-2 and E-2 and therefore the effective size of the entrance hole generated by the shaped charges in each positioning device, the assembly was able to generate total open areas/open surface areas similar to the total open areas of the traditional charge carriers including 2 shaped charges (Sample A-1), 3 shaped charges (Sample B-1), 4 shaped charges (Sample C-1), 5 shaped charges (Sample D-1) and 6 shaped charges (Sample E-2).

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A positioning device, comprising:

a shaped charge holder comprising a plurality of shaped charge receptacles and a lumen extending along a central axis of the shaped charge holder, wherein the shaped charge receptacles extend radially from the central axis of the shaped charge holder and are in a first single axial plane, and each of the receptacles is configured for receiving one of the shaped charges;

a wireless push-in detonator is disposed in the lumen adjacent each of the shaped charge receptacles;

a plurality of retention mechanisms that fasten the shaped charges to the shaped charge holder; and a plurality of shaped charge positioning blocks that guide the placement of the shaped charges, wherein the retention mechanisms and the shaped charge positioning blocks outwardly extend from the shaped charge holder adjacent each of the shaped charge receptacles.

2. The positioning device of claim 1, wherein each of the shaped charge receptacles retains the shaped charge such that a base of the shaped charge is aligned with and in ballistic communication with the detonator.

3. The positioning device of claim 1, wherein the shaped charge receptacles are radially displaced from each other from between 60° and 180°.

4. The positioning device of claim 1, further comprising:

one or more connectors configured for connecting the positioning device to at least one of an adjacent positioning device, an adjacent shaped charge holder and a spacer comprising corresponding connectors, the connectors each extend from an end of the positioning device along the central axis of the shaped charge holder.

5. The positioning device of claim 1, wherein the detonator directly initiates the shaped charges in the shaped charge holder.

6. The positioning device of claim 1, wherein the detonator initiates the shaped charges simultaneously.

7. The positioning device of claim 1, wherein the positioning device is part of a set of perforating gun modules that does not require a sub adapter to connect adjacent gun modules.

8. The positioning device of claim 1, further comprising:

a second plurality of shaped charge receptacles in a second single axial plane displaced axially from the plurality of shaped charge receptacles in the first single axial plane, wherein the second plurality of shaped charge receptacles extend radially from the central axis, and the shaped charges in the second plurality of shaped charge receptacles are initiated by one of the detonator and a detonation extender.

9. The positioning device of claim 8, wherein the detonation extender is a booster.

10. The positioning device of claim 1, wherein the positioning device is formed from a material that is selected from the group comprising an injection molded, casted, or 3D printed plastic material, a 3-D milled plastic material and a material cut from a solid plastic bar stock.

11. A positioning device, comprising:

a detonator holder;

a shaped charge holder extending from the detonator holder, the shaped charge holder comprising a plurality of shaped charge receptacles and a lumen extending along a central axis of the shaped charge holder, wherein the shaped charge receptacles extend radially from the central axis of the shaped charge holder and are in a first single axial plane, and each of the receptacles is configured for receiving one of the shaped charges;

a wireless push-in detonator secured in the detonator holder and extending into at least a portion of the lumen of the shaped charge holder adjacent each of the shaped charge receptacles;

at least one rib outwardly extending from the detonator holder, between a first end of the detonator holder and the shaped charge holder; and a plate at least partially extending around the detonator holder between the first end of the detonator holder and the rib, wherein the plate is configured to capture debris resulting from detonation of the plurality of shaped charges.

12. The positioning device of claim 11, wherein each of the shaped charge receptacles retains the shaped charge such that a base of the shaped charge is aligned with and in ballistic communication with the detonator.

13. The positioning device of claim 11, wherein the shaped charge receptacles are radially displaced from each other from between 60° to 180°.

14. The positioning device of claim 11, further comprising:

a ground bar secured to the detonator holder between the first end of the detonator holder and the plate; and a support member extending from the detonator holder between the ground bar and the plate, wherein the support member is configured to prevent movement of the ground bar along the central axis of the shaped charge holder.

15. The positioning device of claim 11, further comprising at least one of:

a plurality of retention mechanisms that fasten the shaped charges to the shaped charge holder; and a plurality of shaped charge positioning blocks that guide the placement of the shaped charges, wherein the retention mechanisms and the shaped charge positioning blocks outwardly extend from the shaped charge holder adjacent each of the shaped charge receptacles.

16. The positioning device of claim 11, further comprising:

one or more connectors for connecting the positioning device to at least one of an adjacent positioning device, an adjacent shaped charge holder and a spacer comprising corresponding connectors, wherein the connectors each extend from the first end or a second end of the positioning device along the central axis of the shaped charge holder.

17. The positioning device of claim 11, wherein the shaped charge holder and detonator holder are injection molded as a unitary structure.

18. A perforating gun module comprising:

a housing comprising a first housing end, a second housing end, and a chamber extending from the first housing end to the second housing end; and a positioning device secured in the chamber, wherein the positioning device comprises:

a first end and a second end, wherein the first end of the positioning device is spaced apart from the second end of the positioning device, wherein the first end of the positioning device is adjacent the first housing end and the second end of the positioning device is adjacent the second housing end, a shaped charge holder extending between the first and second ends of the positioning device and comprising a plurality of shaped charge receptacles and a lumen extending along a central axis of the shaped charge holder, wherein the shaped charge receptacles extend radially from the central axis of the shaped charge holder and are in a first single axial plane, and each of the receptacles is configured to receive one of the shaped charges, a detonator holder coupled to the first end of the positioning device, at least one rib extending from the detonator holder, wherein the rib engages an inner surface of the housing, and a plate at least partially extending around the detonator holder between the first end of the positioning device and the rib, wherein the plate is configured to capture debris resulting from detonation of the shaped charges, and the chamber is configured to retain a resulting mass formed from the captured debris; and a wireless, push-in detonator extending through the detonator holder, wherein the detonator is at least partially disposed in the lumen of the shaped charge holder, such that the detonator is adjacent each of the shaped charge receptacles.

19. The perforating gun module of claim 18, wherein the positioning device further comprises:

a protrusion extending from a peripheral edge of the plate, wherein the protrusion is configured to engage a slot formed in the inner surface of the housing to secure the positioning device within the perforating gun and prevent rotation of the positioning device within the perforating gun module.

20. The perforating gun module of claim 19, wherein the positioning device comprises:

a disk outwardly and circumferentially extending from the detonator holder between the first end of the positioning device and the plate, wherein the disk is configured to engage an inner surface of the housing of an adjacent gun module and isolate a head of the detonator from metal particles.

21. The perforating gun module of claim 18, wherein the housing comprises:

a recess extending from the second housing end towards the chamber; and a bulkhead assembly positioned between the chamber and the recess, the bulkhead assembly comprising a bulkhead body housing an electrical contact component.

22. The perforating gun module of claim 21, further comprising:

a metal contact plug adjacent a first end of the bulkhead body, wherein the metal contact plug is configured to provide electrical contact to the bulkhead assembly, and a downhole facing pin extends from a second end of the bulkhead body, the downhole facing pin being configured to transfer an electrical signal from the bulkhead assembly to a detonator of an adjacent perforating gun module.

23. The perforating gun module of claim 18, further comprising:

a ground bar secured to the positioning device, wherein the ground bar contacts a portion of an adjacent perforating gun module.

24. The perforating gun module of claim 18, wherein the positioning device comprises:

one or more connectors extending along the central axis of the shaped charge holder, wherein the connectors are configured for connecting the positioning device to an adjacent shaped charge holder comprising a detonation extender adjacent a second plurality of shaped charge receptacles in a second single axial plane, wherein the detonation extender is configured to receive a detonation energy from the wireless push-in detonator to initiate the second plurality of shaped charges.

25. The perforating gun module of claim 18, wherein the shaped charge holder and detonator holder are injection molded as a unitary structure.

* * * * *